US007183027B2

(12) United States Patent
Takegawa et al.

(10) Patent No.: US 7,183,027 B2
(45) Date of Patent: Feb. 27, 2007

(54) IMAGE FORMING METHOD

(75) Inventors: Ichiro Takegawa, Kanagawa (JP); Tsukasa Matsuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 10/795,395

(22) Filed: Mar. 9, 2004

(65) Prior Publication Data

US 2005/0053855 A1 Mar. 10, 2005

(30) Foreign Application Priority Data

Sep. 10, 2003 (JP) ..... 2003-318772
Oct. 27, 2003 (JP) ..... 2003-366510
Nov. 20, 2003 (JP) ..... 2003-390828

(51) Int. Cl.
*G03G 1/46* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS 5,626,998 A * 5/1997 Grabowski et al. ..... 430/67
6,592,984 B1 * 7/2003 Matsuda et al. ..... 428/326
6,936,388 B2 * 8/2005 Suzuki et al. ..... 430/66

FOREIGN PATENT DOCUMENTS

JP A 5-341553 12/1993
JP A 2000-66437 3/2000

OTHER PUBLICATIONS

Jun Takagi; "On-Demand Full Color Digital Xerography Printing System [Color DocuTech 60]"; Journal of the Imaging Society of Japan, the Image Society of Japan; 2001; vol. 40, No. 2; pp. 37-41.

* cited by examiner

*Primary Examiner*—John L Goodrow
(74) *Attorney, Agent, or Firm*—Oliff & Berridge PLC

(57) ABSTRACT

An image forming method includes a photoreceptor preparation step, a coated paper preparation step, a charging step, an exposure step, a development step, and a transfer step. The electrophotographic photoreceptor has a conductive support and a photosensitive layer disposed on the conductive support. The photosensitive layer on the farthest side from the conductive support, includes a surface layer containing at least one selected from the group consisting of fluorine based resin fine particles, a carbonate resin, an arylate resin. The coated paper has a substrate and a coated layer, disposed on at least one surface of the substrate. The coated layer contains an adhesive containing latex having a glass transition temperature of 20° C. or higher and a pigment, and the surface, opposite to the substrate, of the coated layer has a glossiness of 10% or more.

14 Claims, 3 Drawing Sheets

IMAGE FORMING METHOD

BACKGROUND OF THE INVENTION

1. Field of the Invention

The present invention relates to an image forming method.

2. Description of the Related Art

As the image forming method by an electrophotographic mode, a method of successively carrying out charging, exposure, development, and transfer using an electrophotographic photoreceptor is known. In recent years, such image forming method begins to be applied to part of the printing region with the progress of digitalization or colorization, and in particular, practical applications in the graphic arts market including on-demand printing is remarkable. The graphic arts market as referred to herein means the whole of production-related business markets including creative prints having the small number of copies as in woodblock prints, tracing or copying of originals such as handwritings and pictures, and prints by mass production called reproduction and is objective to categories and sections of business related to the production of prints.

Also, practical application of the image forming method using an electrophotographic mode is remarkable in the short run printing market. In this short run printing market, technologies targeting not only monochromic printing but also coloring printing while applying characteristics of plateless printing of the electrophotographic mode (the device is represented by Fuji Xerox's Color DoucTech 60) are developed, and large progresses in image quality, paper correspondence, product price, price per sheet, etc. are being found (*Journal of the Imaging Society of Japan*, the Image Society of Japan, 2001, Vol. 40, No. 2).

In these graphic arts market and short run market, a higher definition of image quality is demanded, and coated papers having a pigment and an adhesive coated thereon for the purpose of preventing penetration of printing inks into paper and coated papers having high white paper gloss for the purpose of enhancing apparent sharpness are used in many cases (for example, JP-A-5-341553 and JP-A-2000-66437).

SUMMARY OF THE INVENTION

However, in the case where the image formation is carried out using coated paper, a paper powder of the coated paper is generated and adheres to the surface of an electrophotographic photoreceptor, thereby possibly generating image void due to a lowering of charge potential of the electrophotographic photoreceptor. Incidentally, in the conventional image forming method, a cleaning step was provided in some case for the purpose of removing a residual toner, etc. from the surface of an electrophotographic photoreceptor after transfer. However, it is difficult to fully remove a paper powder in such a method.

Under these circumstances, the invention has been made. An object of the invention is to provide an image forming method capable of fully preventing the generation of a paper powder of coated paper and adhesion of the paper powder to the surface of an electrophotographic photoreceptor, thereby stably obtaining an image having a high definition of image quality.

For the sake of achieving the foregoing object, first of all, the present inventors made extensive and intensive investigations with respect to any causes of the generation of a paper powder and adhesion of the paper powder to the surface of an electrophotographic photoreceptor in the conventional image forming method using coated paper. As a result, they have obtained the following findings.

That is, in conventional coated paper, for the purpose of preventing penetration of printing inks or revelation of gloss, the surface of paper is coated using a white pigment and latex as an adhesive of the pigment. In general, since such conventional coated paper uses latex having a low glass transition temperature lower than room temperature, a paper powder of the latex of the coated paper adheres to a photoreceptor, causing cleaning failure.

Also, for the purpose of regulating the opacity and whiteness of coated paper, a pigment such as kaolin clay and talc is used. However, in the electrophotographic mode, a roll feeder mode applying a friction force is employed in many cases, many slide sites are present, and a high electric field is formed in the transfer step. Accordingly, these pigments are liable to become a paper powder. In particular, kaolin clay or talc having water of crystallization adheres to the surface of a photoreceptor and lowers the charge potential of the photoreceptor, and therefore, image void likely occurs. Also, in the development, in particular, a toner component is liable to cause moisture absorption, and this likely occurs under high-temperature and high-humidity conditions under which the electrical resistivity of kaolin clay or talc itself is likely lowered.

Now, an image forming method of the invention includes, preparing an electrophotographic photoreceptor, preparing a coated paper, charging the electrophotographic photoreceptor, exposing the charged electrophotographic photoreceptor to form an electrostatic latent image, developing the electrostatic latent image with a toner to form a toner image, and transferring the toner image from the electrophotographic photoreceptor to the coated paper. The electrophotographic photoreceptor includes a conductive support and a photosensitive layer disposed on the conductive support. The photosensitive layer on the farthest side from the conductive support, includes a surface layer containing at least one selected from the group consisting of fluorine based resin fine particles; a carbonate resin containing at least one of a copolymer having two or more repeating units selected from the group consisting of formula (I), (II), (III) and (IV); and a mixture containing two or more homopolymers having a repeating unit selected from the group consisting of formula (I), (II), (III) and (IV), and an arylate resin containing a polymer having one or more repeating units selected from the group consisting of formula (V), (VI), (VII) and (VIII). The coated paper includes a substrate and a coated layer disposed on at least one surface of the substrate. The coated layer contains at least one of an adhesive containing latex having a glass transition temperature of 20° C. or higher and a pigment. A surface, opposite to the substrate, of the coated layer has a glossiness of 10% or more.

(I)

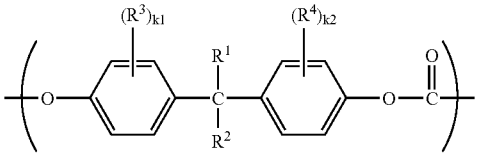

-continued (II)

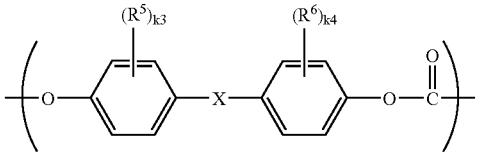

(III)

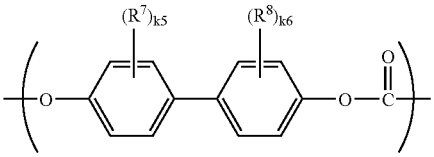

(IV)

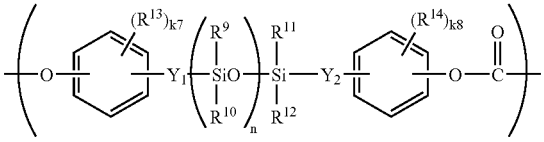

(V)

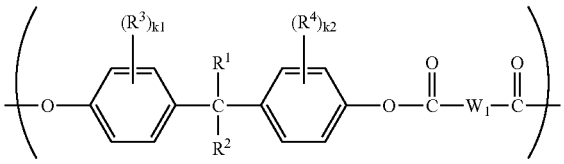

(VI)

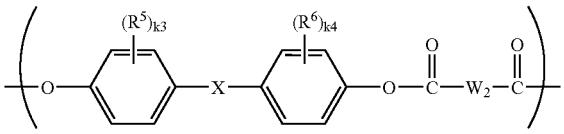

(VII)

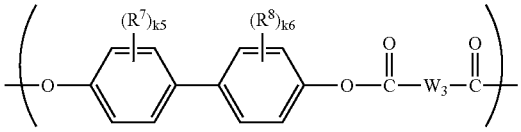

(VIII)

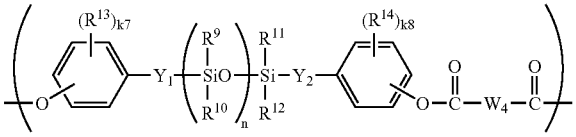

In the formula (I), $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; and $k_1$ and $k_2$ each represents an integer of from 0 to 4.

In the formula (II), X represents a divalent organic group having a single ring or multiple rings; $R^5$ and $R^6$ each independently represents a halogen atom or a substituted or unsubstituted hydrocarbon group; and $k_3$ and $k_4$ each represents an integer of from 0 to 4.

In the formula (III), $R^7$ and $R^8$ each independently represents a halogen atom or a substituted or unsubstituted hydrocarbon group; and $k_5$ and $k_6$ each represents an integer of from 0 to 4.

In the formula (IV), $Y_1$ and $Y_2$ each independently represents an alkylene group; $R^9$ to $R^{12}$ each independently represents a hydrogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $k_7$ and $k_8$ each represents an integer of from 0 to 4; and n represents an integer of from 0 to 150.

In the formula (V), W, represents a divalent organic group having an aromatic ring; $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; and $k_1$ and $k_2$ each represents an integer of from 0 to 4.

In the formula (VI), $W_2$ represents a divalent organic group having an aromatic ring; X represents a divalent organic group having a single ring or multiple rings; $R^5$ and $R^6$ each independently represents a halogen atom or a substituted or unsubstituted hydrocarbon group; and $k_3$ and $k_4$ each represents an integer of from 0 to 4.

In the formula (VII), $W_3$ represents a divalent organic group having an aromatic ring; $R^7$ and $R^8$ each independently represents a halogen atom or a substituted or unsubstituted hydrocarbon group; and $k_5$ and $k_6$ each represents an integer of from 0 to 4.

In the formula (VIII), $W_4$ represents a divalent organic group having an aromatic ring; $Y_1$ and $Y_2$ each independently represents an alkylene group; $R^9$ to $R^{12}$ each independently represents a hydrogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $k_7$ and $k_8$ each represents an integer of from 0 to 4; and n represents an integer of from 0 to 150.

The glossiness as referred to herein means a glossiness measured according to "Testing method for 75 degree specular glossiness of paper and board" as defined in JIS P8142.

An image forming device of the invention includes an electrophotographic photoreceptor, a charging unit for charging the electrophotographic photoreceptor, an exposure unit for exposing the charged electrophotographic photoreceptor to form an electrostatic latent image, a development unit for developing the electrostatic latent image with a toner to form a toner image and a transfer unit for transferring the toner image on the surface of a paper. The electrophotographic photoreceptor includes a conductive support, a photosensitive layer disposed on the conductive support. The photosensitive layer on the farthest side from the conductive support, includes a surface layer containing at least one selected from the group consisting of fluorine based resin fine particles, a carbonate resin containing at least one of a copolymer having two or more repeating units selected from the group consisting of the formula (I), (II), (III) and (IV) and a mixture containing two or more kinds of homopolymers having a repeating unit selected from the group consisting of the formula (I), (II), (III) and (IV), and an arylate resin containing a polymer having one or more repeating units selected from the group consisting of formula (V), (VI), (VII) and (VIII).

According to the invention, the generation of a paper powder of coated paper and adhesion of the paper powder to the surface of an electrophotographic photoreceptor can be fully prevented, image void hardly occurs even under high-temperature and high-humidity conditions, and an image having a high definition of image quality can be stably obtained. Accordingly, the image forming method and the image forming device of the invention are very useful in the graphic arts market and short run market.

DETAILED DESCRIPTION OF THE RELATED ART

Figure 1:
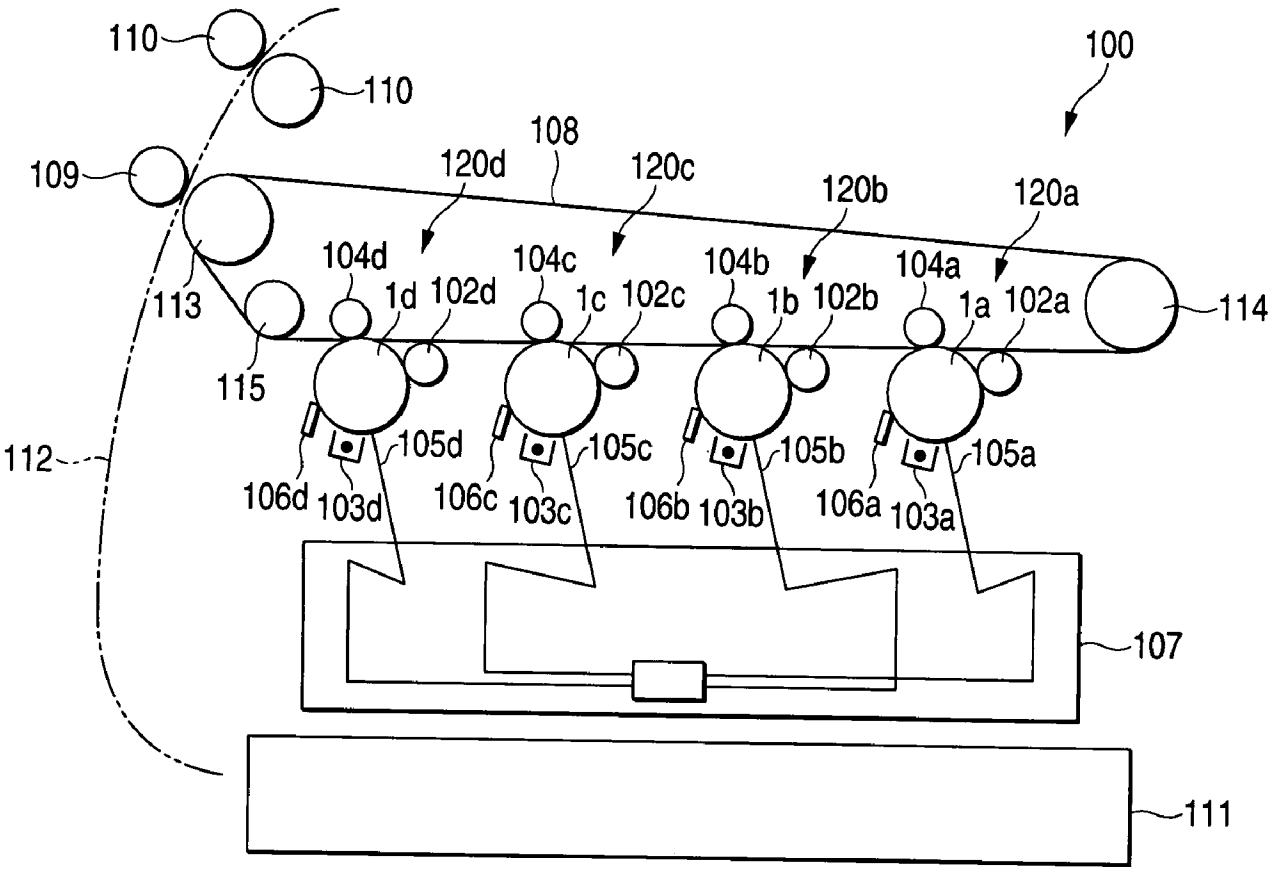
FIG. 1 is a schematic constitutional view showing one suitable embodiment of an image forming device of the invention.

Suitable embodiments of the invention will be described below in detail with reference to the drawings as the case may be. In the drawings, the same or corresponding portions are given the same numerals, and overlapping descriptions are omitted.

FIG. 1 is a schematic constitutional view showing one embodiment of an electrophotographic device to be suitably used in the method of the invention. In FIG. 1, an electrophotographic device 100 is of a tandem type and is an electrophotographic device of a so-called intermediate transfer mode, and is provided with four image forming units 120*a*, 120*b*, 120*c* and 120*d*. The four image forming units 120*a* to 120*d* are disposed in parallel along a part of an intermediate transfer body 108.

Here, the respective image forming units 120*a* to 120*d* are provided with drum-form electrophotographic photoreceptors 1*a* to 1*d*, and the electrophotographic photoreceptors 1*a* to 1*d* can be rotated at a prescribed peripheral speed (process speed) in the prescribed direction (anticlockwise direction on paper). Incidentally, the electrophotographic photoreceptor will be described later in detail.

In the respective electrophotographic photoreceptors 1*a* to 1*d*, charging units 103*a* to 103*d*, development units 102*a* to 102*d*, primary transfer units 104*a* to 104*d*, and cleaning units 106*a* to 106*d* are disposed in order along the rotation direction. Toners of four colors of yellow (Y), magenta (M), cyan (C) and black (K) each contained in a cartridge (not shown) can be fed into the development units 102*a* to 102*d*, and not only black-and-white images but also color images can be formed. Also, the primary transfer units 104*a* to 104*d* come into contact with the electrophotographic photoreceptors 1*a* to 1*d*, respectively via the intermediate transfer body 108.

Incidentally, the development units 102*a* to 102*d* are disposed in the order of the Y, M, C and K toner colors in FIG. 1. However, this order can be properly set up according to the image forming method of, for example, a system of M, Y, C and K.

Further, an exposure unit 107 (for example, an exposure optical system of color separation of original image and image formation, a scanning exposure system by a laser scanner of outputting laser beams modulated corresponding to time series electrical digital pixel signals of image information, etc.) is disposed at a prescribed position of the electrophotographic device 100. Laser beams emitted from the exposure unit 107 are branched into laser beams 105*a* to 105*d* and exposed on the surfaces of the charged electrophotographic photoreceptors 1*a* to 1*d* in the respective image forming units 120*a* to 120*d*, respectively. Thus, charging, exposure, development, primary transfer and cleaning steps are carried out in order in the rotation step of the electrophotographic photoreceptors 1*a* to 1*d*, whereby toners images of respective colors are superimposed on and transferred to the intermediate transfer body 108.

The intermediate transfer body 108 is supported by a prescribed tension by a driving roll 114, a backup roll 113, and a tension roll 115 and can be rotated at the same peripheral speed as in the electrophotographic photoreceptors 1*a* to 1*d* without causing deflection by means of rotation of these rolls. A part of the intermediate transfer body 108 positioned in the middle between the driving roll 114 and the backup roll 113 comes into contact with the electrophotographic photoreceptors 1*a* to 1*d*.

Also, a secondary transfer unit 109 is disposed such that it comes into contact with the backup roll 113 via the intermediate transfer body 108. Also, the intermediate transfer body 108 having passed between the backup roll 113 and the secondary transfer unit 109 is cleaned with respect to the surface thereof by, for example, a cleaning blade (not shown) disposed in the vicinity of the driving roll 114 and then provided for the next image forming process.

Also, a tray 111 is provided at a prescribed position within the electrophotographic device 100. Coated papers described later are put as a medium 112 to be transferred in the tray 111, and the medium 112 to be transferred is conveyed between the secondary transfer unit 109 and the backup roll 113 by a conveyance unit (not shown). The medium 112 to be transferred is successively transported between two fixing rolls 110 coming into contact with each other and discharged out from the electrophotographic device 100.

Incidentally, the conveyance unit of coated paper with in the tray 111 has such a construction the airflow can be blown into the cross-sections of coated papers laminated within the tray 111, and a sheet separating effect is good even under a high-humidity condition, thereby making it possible to achieve stable conveyance.

The image forming method of the invention using the foregoing electrophotographic device 100 will be described below.

First of all, an electrophotographic photoreceptor and coated paper (medium to be transferred) are prepared (electrophotographic photoreceptor preparation step, coated paper preparation step). In the electrophotographic device 100, when the electrophotographic photoreceptors 1*a* to 1*d* are rotated and driven, the charging units 103*a* to 103*d* drive interlockingly. And the surfaces of the electrophotographic photoreceptors 1*a* to 1*d* are uniformly charged at prescribed polarity and potential (charging step). Next, the electrophotographic photoreceptors 1*a* to 1*d*, the surfaces of which have been uniformly charged, are imagewise exposed with the laser beams 105*a* to 105*d* emitted from the exposure unit 107, whereby electrostatic latent images are formed on the surfaces of the photoreceptors 1*a* to 1*d* (exposure step).

The latent images are developed with toners of the development units 102*a* to 102*d* to form toner images (development step). At this time, the toner is of a two-component based toner, but it may be of a one-component based toner.

The toner images are successively subjected to primary (intermediate) transfer onto the outer periphery of the intermediate transfer body 108 by an electric field formed by a primary transfer bias to be applied to the intermediate transfer body 108 from the primary transfer units 104*a* to 104*d* during the course when the toner images pass through the interface (nip portion) between the photoreceptors 1*a* to 1*d* and the intermediate transfer body 108 (intermediate (primary) transfer step). Incidentally, the primary transfer bias to be applied to the intermediate transfer body 108 from the photoreceptors 1*a* to 1*d* is applied at a reverse polarity (+) to the foregoing toner from a bias power source. The applied voltage falls within the range of from +2 kV to +5 kV.

The toner images having a different color according to the respective image forming units 120*a* to 120*d* are superposed on and transferred to the intermediate transfer body 108, thereby forming a color toner image. The color toner image is transferred to the medium 112 to be transferred from the intermediate transfer body 108 by the action of contact charging by the secondary transfer unit 109 (secondary transfer step), and the color toner image is fixed to the medium 112 to be transferred by the fixing rolls 110, thereby forming a color image. Incidentally, in the invention, the toner image is transferred on the surface of coated paper having a glossiness of 10% or more, which is the medium 112 to be transferred. Accordingly, the image definition is sufficiently enhanced.

The electrophotographic photoreceptor to be applied in the foregoing electrophotographic device 100 and the coated paper will be described below.

The electrophotographic photoreceptor includes a conductive support and a photosensitive layer disposed on the conductive support. The photosensitive layer on the farthest side from the support, includes at least one selected from the group consisting of a fluorine based resin fine particle-containing layer, a carbonate resin-containing layer, and an arylate resin-containing layer. The fluorine based resin fine particle-containing layer as referred to herein means a layer containing fluorine based resin fine particles. The carbonate resin-containing layer as referred to herein means a layer containing at least one of a specific copolymer and a mixture of two or more kinds of specific homopolymers described later. The arylate resin-containing layer as referred to herein means a layer containing a specific polymer described later. Incidentally, the photosensitive layer may be basically of a single-layer structure or a laminated structure in which the layer is separated into a charge generation layer and a charge transport layer depending upon the function. In the case of a laminated structure, the lamination order of the charge generation layer and the charge transport layer is arbitrary such that either one may be an upper layer.

By using coated paper comprising a coated layer containing an adhesive containing latex having a glass transition temperature of 20° C. or higher and having a glossiness of 10% or more and using a photoreceptor having at least one selected from the group consisting of a fluorine based resin fine particle-containing layer, a carbonate resin-containing layer, and an arylate resin-containing layer in a photosensitive layer on the farthest side from a support, the generation of a paper powder of the coated paper is suppressed, and even when the amount of the generated paper power is a little, its adhesion to the surface of the photoreceptor is fully prevented, whereby an image having a high definition of image quality can be stably obtained.

Also, it is preferred to use coated paper the coated layer of which contains at least one of kaolin clay and talc. Since the coated layer of coated paper contains an adhesive containing latex having a glass transition temperature of 20° C. or higher, even when kaolin clay or talc is contained in the coated layer, the generation of a paper powder hardly occurs. Accordingly, a pigment can be properly used for the purpose of enhancing the glossiness, etc., whereby it becomes possible to further enhance the definition of image quality.

Also, it is preferable that the surface layer further contains fluorine based resin finer particles, and it is more preferable that the content of the fluorine based resin fine particles is of from 3 to 40% by weight based on the total amount of solids of the surface layer. By further containing the fluorine based resin fine particles, releasability of the electrophotographic photoreceptor is enhanced. Also, by regulating the content of the fluorine based resin fine particles within the foregoing range, it becomes possible to uniformly disperse the fluorine based resin particles in the layer. Accordingly, an effect for preventing adhesion of a paper power of the coated paper to the surface of the electrophotographic photoreceptor can be further enhanced.

Also, it is preferred to use the electrophotographic photoreceptors in which the foregoing surface layer further contains a fluorine based polymer. By containing a fluorine based polymer in the fluorine based resin fine particle-containing layer, it is possible to further enhance dispersion uniformity of the fluorine based resin fine particles. Accordingly, an effect for preventing adhesion of a paper power of the coated paper to the surface of the electrophotographic photoreceptor can be further enhanced.

Figure 2:
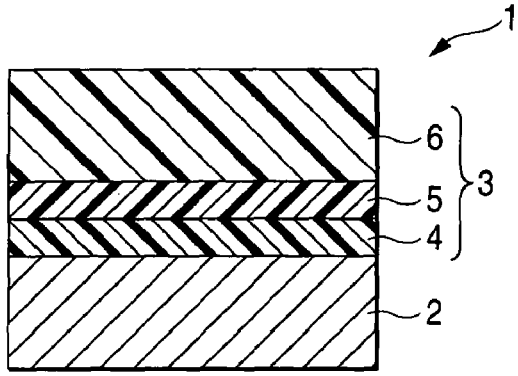
FIG. 2 is a schematic cross-sectional view showing one suitable embodiment of an electrophotographic photoreceptor.
Figure 3:
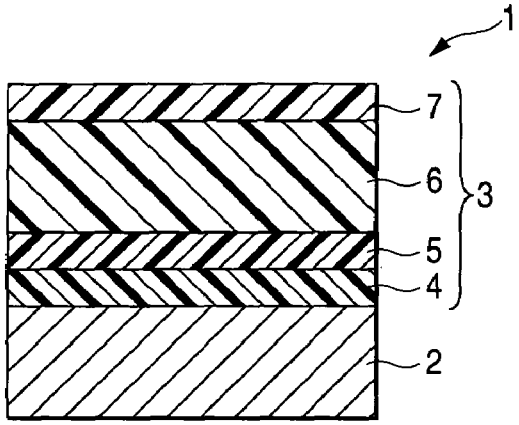
FIG. 3 is a schematic cross-sectional view showing one suitable embodiment of an electrophotographic photoreceptor.
Figure 4:
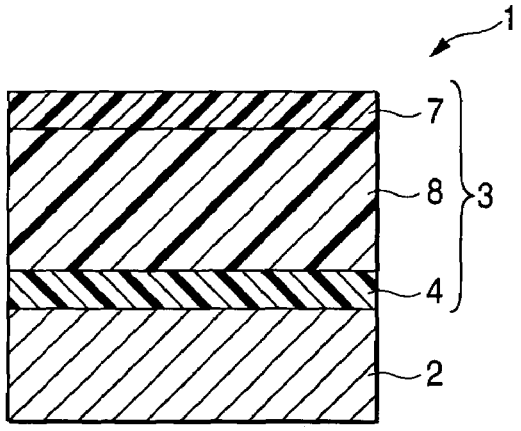
FIG. 4 is a schematic cross-sectional view showing one suitable embodiment of an electrophotographic photoreceptor.

Preferred embodiments of the electrophotographic photoreceptor will be described below in detail. FIGS. 2 to 4 are each a schematic cross-sectional view showing one suitable embodiment of the electrophotographic photoreceptor. The electrophotographic photoreceptors shown in FIGS. 2 to 3 are each provided with a photosensitive layer 3 in which the function is separated into a layer containing a charge generation material (charge generation layer 5) and a layer containing a charge transport material (charge transport layer 6). Also, FIG. 4 is concerned with an embodiment where a charge generation material and a charge transport material are contained in the same layer (single-layer type photosensitive layer 8).

An electrophotographic photoreceptor 1 shown in FIG. 2 has such a structure that a subbing layer 4, a charge generation layer 5, and a charge transport layer 6 are laminated in that order on a conductive support 2. The charge transport layer 6 has at least one selected from the group consisting of a fluorine based resin fine particle-containing layer, a carbonate resin-containing layer, and an arylate resin-containing layer. Also, an electrophotographic photoreceptor 1 shown in FIG. 3 has such a structure that a subbing layer 4, a charge generation layer 5, a charge transport layer 6, and a protective layer 7 are laminated in that order on a conductive support 2. The protective layer 7 is at least one selected from the group consisting of a fluorine based resin fine particle-containing layer, a carbonate resin-containing layer, and an arylate resin-containing layer. Also, an electrophotographic photoreceptor 1 shown in FIG. 4 has such a structure that a subbing layer 4, a single-layer type photosensitive layer 8, and a protective layer 7 are laminated in that order on a conductive support 2. The protective layer 7 is at least one selected from the group consisting of a fluorine based resin fine particle-containing layer, a carbonate resin-containing layer, and an arylate resin-containing layer.

Next, each of the elements of the electrophotographic photoreceptor 1 will be described below in detail with reference to FIG. 2.

Examples of the conductive support 2 include metallic drums made of aluminum, copper, iron, stainless steel, zinc, nickel, etc.; ones comprising a support (such as sheets, papers, plastics, and glasses) having a metal (such as aluminum, copper, gold, silver, platinum, palladium, titanium, nickel-chromium, stainless steel, and copper-indium) vapor deposited thereon; ones comprising the foregoing support having a conductive metal compound (such as indium oxide and tin oxide) vapor deposited thereon; ones comprising the foregoing support having a metal foil laminated thereon; and ones prepared by dispersing carbon black, indium oxide, a tin oxide-antimony oxide powder, a metal powder, copper iodide, etc. in a binder resin and coating the dispersion on the foregoing support, thereby making it conductive. Incidentally, the shape of the conductive support 2 may be any of a drum form, a sheet form, or a plate form.

In the case where a metal pipe substrate is used as the conductive support 2, the surface of such a substrate may be of a plain pipe, or may be subjected in advance to a treatment such as mirror cutting, etching, anodic oxidation, rough cutting, centerless grinding, sandblast, and wet honing.

Also, conductive plastic substrates prepared by dispersing conductive fine particles such as carbon black particles, metal fine powders, and metal oxide fine particles in a binder resin and molding the dispersion into a pipe form by a centrifugal molding machine, an extrusion molding machine, etc. can be used.

However, for the sake of obtaining high-image quality images, ones prepared by anodically oxidizing the surface of an aluminum substrate, or ones in which a dispersion type subbing layer is formed by dispersing and coating metal oxide fine particles on an aluminum substrate to obtain carrier blocking property are preferable.

The anodic oxidation of the aluminum substrate surface can be carried out in the following manner. That is, first of all, as the aluminum substrate, any of pure aluminum or aluminum alloys can be used. Suitable examples thereof include aluminum of Material Code A1000 Series, Material Code A3000 Series, and Material Code A6000 Series as defined in JIS H4080 and aluminum alloys. Anodically oxidized films are formed by anodic oxidation of a variety of metals or a variety of alloys in an electrolyte solution. Above all, a coating film called alumite, which is formed by anodic oxidation of aluminum or an aluminum alloy in an electrolyte solution, is suitable as the photoreceptor to be used in this embodiment.

The alumite coating film has high carrier blocking property and is especially excellent in the point of preventing point defects (such as black spots and surface staining) generated in applying reversal development (negative or position development). Also, it is excellent from the standpoint that a current leakage phenomenon from a contact charger, which is liable to occur at the time of contact charging, can be prevented.

The anodic oxidation treatment is carried out in an acidic bath such as chromic acid, sulfuric acid, oxalic acid, phosphoric acid, boric acid, and sulfamic acid. Above all, the treatment with a sulfuric acid bath is the most suitable. One example of the treatment condition is as follows. That is, in general, the sulfuric acid concentration is from 10 to 20%; the bath temperature is from 5 to 25° C.; the current density is from 1 to 4 A/dm$^2$; the electrolytic voltage is from 5 to 30 V; and the treatment time is from about 5 to 60 minutes. However, it should not be construed that the invention is limited thereto. The thus formed anodically oxidized film is porous and highly insulating, and its surface is very unstable. For that reason, physical properties values of the film are liable to change after the film formation. For the sake of avoiding this, the anodically oxidized film is generally further subjected to sealing treatment. Examples of the sealing treatment include a method in which the anodically oxidized film is immersed in an aqueous solution containing nickel fluoride or nickel acetate, a method in which the anodically oxidized film is immersed in boiling water, and a method in which the anodically oxidized film is treated with water vapor under pressure. Of these methods, a method of immersing in an aqueous solution containing nickel acetate is the most general.

Subsequent to the sealing treatment, the resulting anodically oxidized film is subjected to washing treatment. This is carried out for the main object of removing excessive materials such as metal salts as adhered by the sealing treatment. When such excessive metal salts and the like remain excessively on the surface of the support (anodically oxidized film), the quality of a coating film (subbing layer 4) to be formed on the anodically oxidized film is adversely affected. Further, in general, low-resisting components remain, whereby the generation of surface staining is inversely caused. Though the washing treatment may be carried out by one-stroke treatment with pure water, washing is usually carried out in multiple stages. During this, it is preferable that the final washing is clean as far as possible (deionized). Also, it is desirable that physical rubbing washing with a contact member is applied to at least one step of the washing step in multiple stages.

The thus formed anodically oxidized film suitably has a film thickness of from 3 to 15 μm. Also, a layer called a barrier layer is present beneath the porous anodically oxidized layer in the anodically oxidized film. The barrier layer suitably has a film thickness of from 1 to 100 nm in the present system.

Incidentally, in the case where the film thickness of the anodically oxidized film is less than 3 μm, the effect of barrier property as the anodically oxidized film tends to become insufficient. On the other hand, in the case where it exceeds 15 μm, the time constant as an electrode becomes too large, there are tendencies that a residual potential is generated, that the repeating characteristic is deteriorated, and that responsibility of the photoreceptor is deteriorated.

For the purposes of improving wetting property at the time of coating upper layers (such as the charge generation layer 5) and strengthening blocking property, it is preferred to form the subbing layer 4 on the conductive support 2. Incidentally, the subbing layer 4 is a layer also called a carrier blocking layer or an anodically oxidized layer.

Examples of materials of the subbing layer 4 include binder resins (high-molecular resin compounds) and organometallic compounds.

Examples of high-molecular resin compounds include acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins. These resin compounds can be used singly or in combination of two or more thereof. Incidentally, in the case of the combination, the resin compounds can be used as a mixture or a polycondensate.

Also, examples of organometallic compounds include those containing a zirconium, titanium, aluminum, manganese, or silicon atom. More specifically, silicon compounds, organozirconium compounds, organotitanium compounds, and organoaluminum compounds are enumerated. These organometallic compounds can be used singly or in combination of two or more thereof. Incidentally, in the case of the combination, the organometallic compounds can be used as a mixture or a polycondensate. Of the foregoing organometallic compounds, organometallic compounds containing zirconium or silicon are superior in performance such that they are low in residual potential, less in change of the potential by the environment, and less in change of the potential by repeated use, and therefore, these compounds are preferable.

Examples of silicon compounds of the organometallic compounds include vinyl trimethoxysilane, γ-methacryloxypropyl tris(β-methoxyethoxy) silane, β-(3,4-epoxycyclohexyl)ethyl trimethoxysilane, γ-glycidoxypropyl trimethoxysilane, vinyl triacetoxysilane, γ-merpactopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysolane, N,N-bis(β-hydroxyethyl)-γ-aminopropyl triethoxysilane, and γ-chloropropyl trimethoxysilane. Of these silicon compounds, silane coupling agents such as vinyl triethoxysilane, vinyl tris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-(aminoethyl)-3-aminopropyl trimethoxysilane, N-2-(aminoethyl)-3-aminopropylmethyl dimethoxysilane, 3-aminopropyl triethoxysilane, N-phenyl-3-aminopropyl trimethoxysilane, 3-mercaptopropyl trimethoxysilane, and 3-chloropropyl trimethoxysilane are preferably used.

Examples of organozirconium compounds include zirconium butoxide, zirconium ethyl acetoacetate, zirconium triethanolamine, acetylacetonatozirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of organotitanium compounds include tetraisopropyl titanate, tetra-n-butyl titanate, butyl titanate dimer, tetra( 2-ethylehxyl) titanate, acetylacetonatotitanium, polyacetylacetonatotitanium, titanium octylene glycolate, titanium lactate ammonium salt, titanium lactate, titanium lactate ethyl ester, titanium triethanol aminate, and polyhydroxytitanium stearate.

Examples of organoaluminum compounds include aluminum isopropylate, monobutoxyaluminum diisopropylate, aluminum butyrate, diethyl acetoacetate aluminum diisopropylate, and aluminum tris(ethyl acetoacetate).

The subbing layer 4 can be formed by preparing a coating solution for forming a subbing layer using the foregoing material, coating the coating solution on the conductive support 2, and then drying it.

A variety of additives can be used in the coating solution for forming a subbing layer for the purposes of enhancing the electric characteristics, enhancing the environmental safety, and enhancing the image quality.

As additives, known materials including electron transporting compounds such as quinone based compounds (for example, chloranil, bromanil, and anthraqinone), tetracyanoquinodimethane based compounds, fluorenone compounds (for example, 2,4,7-trinitrofluorenone and 2,4,5,7-tetranitro-9-fluorenone), oxadiazole based compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone based compounds, thiophene compounds, and diphenoquinone compounds (for example, 3,3',5,5'-tetra-t-butyldiphenoquinone), electron transporting pigments (for example, polycyclic condensed types and azo types), zirconium chelate compounds, titanium chelate compounds, aluminum chelate compounds, titanium alkoxide compounds, organotitanium compounds, and silane coupling agents can be used.

Though the silane coupling agent is used for the surface treatment of metal oxide fine particles described later, it can be added as an additive in the coating solution and used. Specific examples of the silane coupling agent that is used herein are the same as in the coupling agent to be used for the surface treatment of metal oxide fine particles.

Examples of zirconium chelate compounds include zirconium butoixe, zirconium ethyl acetoacetate, zirconium triethanolamine, acetylacetonatozirconium buxoide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of titanium chelate compounds include tetraisopropyl titanate, tetra-n-butyl titanate, butyl titanate dimer, tetra( 2-ethylehxyl) titanate, acetylacetonatotitanium, polyacetylacetonatotitanium, titanium octylene glycolate, titanium lactate ammonium salt, titanium lactate, titanium lactate ethyl ester, titanium triethanol aminate, and polyhydroxytitanium stearate.

Examples of aluminum chelate compounds include aluminum isopropylate, monobutoxyaluminum diisopropylate, aluminum butyrate, diethyl acetoacetate aluminum diisopropylate, and aluminum tris(ethyl acetoacetate).

These compounds can be singly or in combination of two or more thereof.

As solvents that are used in the coating solution for forming a subbing layer, known organic solvents such as aromatic hydrocarbon based solvents (for example, toluene and chlorobenzene), aliphatic alcohol based solvents (for example, methanol, ethanol, n-propanol, isopropanol, and n-butanol); ketone based solvents (for example, acetone, cyclohexanone, and 2-butanone), halogenated aliphatic hydrocarbon based solvents (for example, methylene chloride, chloroform, and ethylene chloride), cyclic or linear ether based solvents (for example, tetrahydrofuran, dioxane, ethylene glycol, and diethyl ether), and ester based solvents (for example, methyl acetate, ethyl acetate, and n-butyl acetate) are used. These solvents can be used singly or in combination of two or more thereof. In the case that these solvents are mixed, any solvents can be used so far as a mixed solvent thereof can dissolve the binder resin therein.

Also, with respect to the dispersion method of the coating solution, media dispersion machines such as a ball mill, a vibration mill, an attritor, a sand mill, and a horizontal sand mill, and medialess dispersion machines such as an agitator, an ultrasonic dispersion machine, a roll mil, and a high-pressure homogenizer can be utilized. Further, examples of the high-pressure homogenizer include a collision mode in which the dispersion liquid is subjected to liquid-liquid collision or liquid-wall collision in the high-pressure state and dispersed and a penetration mode in which the dispersion liquid is penetrated into a fine passage and dispersed.

Also, as the coating method, usual methods such as an immersion coating method, a ring coating method, a wire bar coating method, a spray coating method, a blade coating method, a knife coating method, and a curtain coating method can be employed.

It is preferable that the subbing layer 4 formed using the foregoing coating solution has a film thickness of from 0.1 to 3 μm. In the case where the film thickness exceeds 3 μm, an electric barrier becomes too strong, whereby desensitization or an increase in potential due to repeating is liable to occur.

Also, the subbing layer 4 may be of a subbing layer of a type in which a metal oxide having a proper resistance value is dispersed in a resin, thereby properly adjusting the resistance value and preventing accumulation of the residual charges, while keeping the fixed film thickness to increase leakage resistance of the photoreceptor, especially an ability to prevent leakage at the time of contact charging (dispersion type subbing layer). In that case, by dispersing a resistance controlling agent, it becomes possible to make the film thickness thicker than that in the foregoing construction, whereby the resulting receptor can be used in a thicker film thickness.

As the dispersion type subbing layer, for example, those prepared by dispersing a metal powder (for example, aluminum, copper, nickel, and silver), a conductive metal oxide (for example, antimony oxide, indium oxide, tin oxide, and zinc oxide), or a conductive substance (for example, carbon fiber, carbon black, and graphite powders) in a binder resin and coating the dispersion on the conductive support 2 are enumerated.

As the conductive metal oxide, fine particles having a mean particle size of not more than 0.5 μm are preferably used. The mean particle size as referred to herein means a mean primary particle size. The subbing layer is required to obtain an adequate resistance for the purpose of obtaining leakage resistance, and therefore, it is preferable that the conductive metal oxide fine particles have a powder resistance of from $10^2$ to $10^{11}$ Ω·cm. Above all, it is preferred to use conductive metal oxide fine particles of tin oxide, titanium oxide, zinc oxide, etc. having the foregoing resistance value. Incidentally, when the powder resistance is less than $10^2$ Ω·cm, sufficient leakage resistance is liable to be not obtained. On the other hand, when it exceeds $10^{11}$ Ω·cm, possibility to cause an increase of the residual potential is liable to become high.

Also, the conductive metal oxide fine particles can be used in combination of two or more kinds thereof. Further, by surface treatment of the metal oxide fine particles with a coupling agent, it is possible to control the resistance of the powder. As the coupling agent that can be used, the same materials described previously for the non-dispersion type subbing layer can be used.

Specific examples of the coupling agent include vinyl trimethoxysilane, γ-methacryloxypropyl tris(β-methoxyethoxy)silane, γ-(3,4-epoxycyclohexyl)ethyl trimethoxysilane, γ-glycidoxypropyl trimethoxysilane, vinyl triacetoxysilane, γ-merpactopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysolane, N,N-bis(β-hydroxyethyl)-γ-aminopropyl triethoxysilane, and γ-chloropropyl trimethoxysilane. These coupling agents can be used singly or in combination of two or more thereof.

As the surface treatment method, known methods can be employed, but a dry method or a wet method is preferable. In the case where the surface treatment is carried out in a dry method, the coupling agent is directly dropped or a solution of the coupling agent in an organic solvent or water is dropped and sprayed together with dry air or nitrogen gas while stirring the metal oxide fine particles by, for example, a mixer having a large shear force, whereby the surfaces of the metal oxide fine particles are uniformly treated. In the addition or spraying, it is preferable that the treatment is carried out at a temperature of 50° C. or higher. After the addition or spraying, it is possible to further conduct baking at 100° C. or higher.

The baking can be carried out under arbitrary conditions of temperature and time so far as desired electrophotographic characteristics are obtained. In the dry method, the surface-adsorbed water can be removed by heat drying the metal oxide fine particles prior to the surface treatment with a coupling agent. By removing the surface-adsorbed water prior to the treatment, it is possible to uniformly adsorb the coupling agent on the surfaces of the metal oxide fine particles.

In the wet method, the metal oxide fine particles are stirred in a solvent and dispersed using ultrasonic waves, a sand mill, an attritor, a ball mill, etc. Further, a coupling solution is added or dispersed, and the solvent is then removed, whereby the surfaces of the metal oxide fine particles are uniformly treated. After removing the solvent, it is possible to further conduct baking at 100° C. or higher. The baking can be carried out under arbitrary conditions of temperature and time so far as desired electrophotographic characteristics are obtained. In the wet method, the surface-adsorbed water can be removed, too by heat drying the metal oxide fine particles prior to the surface treatment with a coupling agent. As the method of removing the surface-adsorbed water, in addition to the same heat drying method as in the dry method, a method of removing it while stirring and heating in the solvent to be used for the surface treatment, and a method of removing it by azeotropy together with the solvent can be employed.

As the amount of the surface treating agent against the metal oxide fine particles, an amount at which the desired electrophotographic characteristics are obtained is essential.

The electrophotographic characteristics are influenced by the amount of the surface treating agent adhered to the metal oxide fine particles after the surface treatment. In the case of a silane coupling agent, its adhesion amount is determined from the intensity of Si in the fluorescent X-ray analysis and the intensity of the major metal element of the metal oxide. The intensity of Si in the fluorescent X-ray analysis is preferably in the range of from $1.0\times10^{-5}$ to $1.0\times10^{-3}$ of the intensity of the major metal element of the metal oxide. In the case where the intensity of Si is less than $1.0\times10^{-5}$, defects in image quality such as fogging are liable to occur. On the other hand, when it exceeds $1.0\times10^{-3}$, a lowering of the concentration due to an increase of the residual potential is liable to occur.

As the binder resin in the dispersion type subbing layer, known high-molecular resin compounds such as acetal resins (for example, polyvinyl butyral), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenols resins, phenol-formaldehyde resins, melamine resins, and urethane resins; charge transporting resins having a charge transporting group; and conductive resins such as polyaniline can be used. Of these, resins insoluble in the coating solvent in the upper layer are preferably used; and phenol resins, phenol-formaldehyde resins, melamine resins, urethane resins, and epoxy resins are especially preferably used.

The ratio of the metal oxide fine particles to the binder resin in the coating solution for forming a dispersion type subbing layer can be arbitrarily set up within the range in which desired electrophotographic characteristics are obtained.

As the method of dispersing the metal oxide fine particles, the same dispersion method as described previously can be employed. As the method of coating to form a dispersion type subbing layer, the same dispersion method as described previously can be employed.

The thus formed dispersion type subbing layer preferably has a film thickness of 3 μm or more, and more preferably from 5 to 30 μm. Further, for the sake of enhancing the leakage resistance, it is preferable that the dispersion type subbing layer is of a resin or filler construction such that the Vickers hardness is 35 or more.

Also, in some case, for the sake of preventing an interference fringe image by laser sources, the surface roughness of the dispersion type subbing layer is adjusted at from about ¼ (n) times of the exposure laser wavelength λ (wherein n represents a refractive index of the upper layer) to λ. In order to adjust the surface roughness, resin particles can be added in the dispersion type subbing layer. Examples of resin particles that can be used include silicone resin particles and crosslinking type PMMA resin particles. Also, in order to adjust the surface roughness, the subbing layer can be abraded. Examples of abrasion methods that can be employed include buffing, sandblasting, wet honing, and grinding.

The charge generation layer 5 is constituted of a charge generation material.

Examples of charge generation materials include inorganic photoconductors (for example, amorphous selenium, crystalline selenium, selenium-tellurium alloys, selenium-arsenic alloys, other selenium compounds, selenium alloys, amorphous silicon, and cadmium sulfide) and those sensitized with a dye; a variety of organic pigments such as a variety of phthalocyanine pigments (for example, non-metallic phthalocyanine, titanyl phthalocyanine, copper phthalocyanine, tin phthalocyanine, and gallium phthalocyanine), naphthocyanine pigments, squalium based pigments, anthoanthrone based pigments, perylene based pigments, azo based pigments, trisazo based pigments, anthraquinone based pigments, pyrene based pigments, pyrylium salts, and thiopyrylium salts; and dyestuffs. Also, these organic pigments generally have several kinds of crystal forms. In particular, in phthalocyanine pigments, various crystal forms including an α-form and a β-form are known. But, any crystal forms can be used so far as the pigment can obtain sensitivity adaptive to the object and other characteristics.

In this embodiment, the following compounds are especially suitable as the charge generation material capable of obtaining an excellent performance. That is, examples include hydroxygallium phthalocyanine represented by a crystal form having diffraction peaks at positions of at least 7.6°, 10.0°, 25.2° and 28.0° in a Bragg angle (2θ±0.2°) of the X-ray diffraction spectrum using CuKα-rays; chlorogallium phthalocyanine represented by a crystal form having diffraction peaks at positions of at least 7.3°, 16.5°, 25.4° and 28.1° in a Bragg angle (20±0.2°) of the X-ray diffraction spectrum using CuKα-rays; and titanyl phthalocyanine represented by a crystal form having diffraction peaks at positions of at least 9.5°, 24.2° and 27.3° in a Bragg angle (2θ±0.20) of the X-ray diffraction spectrum using CuKα-rays.

Incidentally, these peak intensities and positions may possibly delicately deviate from these values depending upon the crystal shape and measurement method. However, in case that the X-ray diffraction pattern basically coincides, it can be understood that the crystal form is the same.

The charge generation layer can be formed by vapor depositing the charge generation material on the subbing layer 4, or by preparing a coating solution for forming a charge generation layer together with an organic solvent and a binder resin and coating the coating solution on the subbing layer 4.

As the binder resin to be used in preparing the coating solution for forming a charge generation layer, the following can be enumerated. That is, examples include polycarbonate resins such as bisphenol A types and bisphenol Z types or copolymers thereof, polyarylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins, and poly-N-vinylcarbazoles. These binder resins can be used singly or in combination of two or more thereof.

Also, as the organic solvent to be used in preparing the coating solution for forming a charge generation layer, known organic solvents can be used.

The compounding ratio (weight ratio) of the charge generation material to the binder resin in preparing the coating solution for forming a charge generation layer is desirably in the range of from 10/1 to 1/10. Also, as the method of dispersing the charge generation material in the resin, a method using a roll mill, a ball mill, a vibration ball mill, an attritor, a dynomill, a sand mill, a colloid mill, or the like can be employed. Also, coating of the coating solution can be carried out in the usual methods.

The charge generation layer formed by the method described above preferably has a film thickness of from 0.01 to 5 μm, and more preferably from 0.05 to 2.0 μm.

The charge transport layer 6 is constituted of a charge transport material and a binder resin. Incidentally, it is preferable that the charge transport layer 6 contains fluorine based resin fine particles. In the photoreceptor 1 shown in FIG. 2, the charge transport layer 6 is provided on the farthest side of the photosensitive layer 3 from the support 2 such that the charge transport layer comes into contact with a medium to be transferred.

The fluorine based resin fine particles are a fine particle containing a fluorine based resin. The fluorine based resin as referred to herein is a resin containing a fluorine resin. More specifically, it is preferred to use one kind or a combination of two or more kinds of tetrafluoroethylene resins, trifluorochloroethylene resins, hexafluoropropylene resins, vinyl fluoride resins, vinylidene fluoride resins, difluorodichloroethylene resins, and copolymers thereof. Of these fluorine based resins, tetrafluoroethylene resins and/or vinyldene fluoride resins are preferable.

The fluorine based resin fine particles preferably have a primary particle size of from 0.05 to 1 μm, and more preferably from 0.1 to 0.5 μm. When the primary particle size is less than 0.05 μm, coagulation is liable to occur at the time of dispersion. On the other hand, when it exceeds 1 μm, defects in image quality are liable to occur. Incidentally, the primary particle size can be measured by the measurement of BET value or by units such as electron microscopic observation.

Examples of the charge transport material include hole transport compounds such as oxadiazole derivatives (for example, 2,5-bis(p-diethylaminophenyl)-1,3,4-oxadiazole), pyrazoline derivatives (for example, 1,3,5-triphenyl-pyrazoline and 1-[pyridyl-(2)]-3-(p-diethylaminostyryl)-5-(p-diethylaminostyryl)pyrazolone), aromatic tertiary amino compounds (for example, triphenylamine, tri(p-methyl) phenylamine, N,N-bis(3,4-dimethylphenyl)biphenyl-4-amine, dibenzylaniline, and 9,9-dimethyl-N,N-di-(p-tolyl) fluorenone-2-amine), aromatic tertiary diamino compounds (for example, N,N'-diphenyl-N,N'-bis(3-methylphenyl)-[1,1-biphenyl]-4,4'-diamine), 1,2,4-triazine derivatives (for example, 3-(4'-dimethylaminophenyl)-5,6-di-(4'-methoxyphenyl)-1,2,4-triazine), hydrazone derivatives (for example, 4-diethyaminobenzaldehyde-1,1-diphenylhydrazone, 4-diphenylaminobenzaldehyde-1,1-diphenylhydrazone, [p-(diethylamino)phenyl]-(1-naphthyl)phenylhydrazone, 1-pyrenediphenylhydrazone, 9-ethyl-3-[(2-methyl-1-indolynylimino)methyl]carbazole, 4-(2-methyl-1-indolynylimiomethyl)triphenylamine, 9-methyl-3-carbazole diphenylhydrazone, 1,1-di(4,4'-methoxyphenyl)acrylaldehyde diphenylhydrazone, and β,β-bis-(methoxypheny)vinyl diphenylhydrazone), quinazoline derivatives (for example, 2-phenyl-4-styryl-quinazoline), benzofuran derivatives (for example, 6-hydroxy-2,3-di(p-methoxyphenyl)-benzofuran), α-stilbene derivatives (for example, p-(2,2-diphenylvinyl)-N,N-diphenylaniline), enamine derivatives, carbazole derivatives (for example, N-ethylcarbazole), and poly-N-vinylcarbazole and derivatives thereof; and electron transport compounds such as quinone based compounds (for example, chloranil, bromanil, and anthraqinone), tetracyanoquinodimethane based compounds, fluorenone compounds (for example, 2,4,7-trinitrofluorenone and 2,4,5,7-tetranitro-9-fluorenone), oxadiazole based compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone based compounds, thiophene compounds, and diphenoquinone compounds (for example, 3,3',5,5'-tetra-t-butyldiphenoquinone and 3,5-dimethyl-3',5'-di-t-butyl-4,4'-diphenoquinone). Also, polymers having a group comprising the foregoing compound in the main chain or side chain thereof are enumerated. These charge transport compounds can be used singly or in combination of two or more thereof.

As the binder resin, those containing a copolymer having two or more kinds of repeating units represented by the following general formula (I), (II), (III) or (IV) and/or a mixture containing two or more kinds of homopolymers having a repeating unit presented by the following general formula (I), (II), (III) or (IV) are enumerated.

In the formula (I), $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; and $k_1$ and $k_2$ each represents an integer of from 0 to 4.

(I)

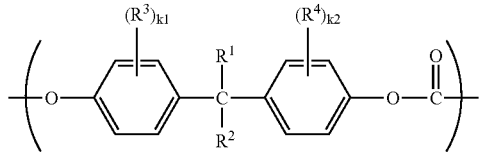

In the formula (II), X represents a divalent organic group having a single ring or multiple rings; $R^5$ and $R^6$ each independently represents a halogen atom or a substituted or unsubstituted hydrocarbon group; and $k_3$ and $k_4$ each represents an integer of from 0 to 4.

(II)

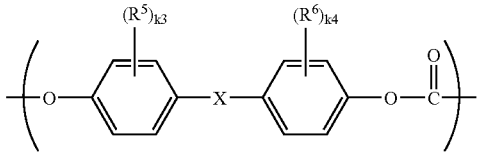

In the formula (III), $R^7$ and $R^8$ each independently represents a halogen atom or a substituted or unsubstituted hydrocarbon group; and $k_5$ and $k_6$ each represents an integer of from 0 to 4.

(III)

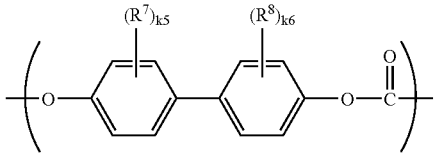

In the formula (IV), $Y_1$ and $Y_2$ each independently represents an alkylene group; $R^9$ to $R^{12}$ each independently represents a hydrogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $k_7$ and $k_8$ each represents an integer of from 0 to 4; and n represents an integer of from 0 to 150.

(IV)

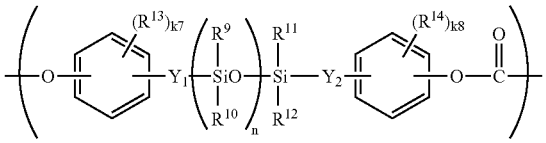

In the foregoing formula (I), the unsubstituted hydrocarbon group represented by $R^1$ and $R^2$ is preferably an aliphatic hydrocarbon group or an aromatic hydrocarbon group; and more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms). Also, the substituted hydrocarbon group is preferably one substituted with a halogen atom or the foregoing linear or branched alkyl group. Also, the substituted heterocyclic group is preferably one substituted with a halogen atom or the foregoing linear or branched alkyl group.

In the foregoing formula (I), the unsubstituted hydrocarbon group represented by $R^3$ and $R^4$ is preferably an aliphatic hydrocarbon group or an aromatic hydrocarbon group; and more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms). Also, the substituted hydrocarbon group is preferably one substituted with a halogen atom or the foregoing linear or branched alkyl group.

In the foregoing formula (II), the single ring or multiple rings in the divalent organic group having a single ring or multiple rings represented by X may be a hydrocarbon ring group or a heterocyclic group. Incidentally, as the heterocyclic group, the same unsubstituted heterocyclic groups as in $R^1$ and $R^2$ can be enumerated. The divalent organic group represented by X is more preferably any one selected from the following (II-a) to (II-e).

In the formula (II-a), $R^{20}$ represents an alkylene group (preferably an alkylene group having from 1 to 15 carbon atoms).

(II-a)

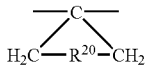

In the formula (II-b), $R^{21}$ represents a hydrocarbon group (preferably an alkyl group having from 1 to 6 carbon atoms); and $k_{10}$ represents an integer of from 1 to 8.

(II-b)

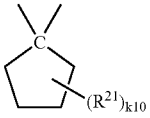

In the formula (II-c), $R^{22}$ represents a hydrocarbon group (preferably an alkyl group having from 1 to 6 carbon atoms); and $k_{11}$ represents an integer of from 1 to 10.

(II-c)

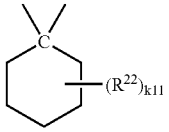

(II-d)

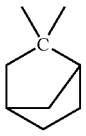

-continued (II-e)

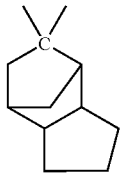

Preferred examples of $R^5$ and $R^6$ in the foregoing formula (II) and preferred examples of $R^7$ and $R^8$ in the foregoing formula (III) are the same as in $R^3$ and $R^4$ in the foregoing formula (I).

In the foregoing formula (IV), $Y_1$ and $Y_2$ are preferably an alkylene group having from 1 to 6 carbon atoms; and the unsubstituted hydrocarbon group represented by $R^9$ to $R^{12}$ is preferably an aliphatic hydrocarbon group or an aromatic hydrocarbon group, more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms), and further preferably a methyl group or a phenyl group. Also, the substituted hydrocarbon group is preferably one substituted with a halogen atom or the foregoing linear or branched alkyl group. As the substituted or unsubstituted heterocyclic group represented by $R^9$ to $R^{12}$, the same as in $R^1$ and $R^2$ in the foregoing formula (I) can be enumerated. Preferred examples of $R^{13}$ and $R^{14}$ in the foregoing formula (IV) are those enumerated for $R^3$ and $R^4$ in the foregoing formula (I).

Specific examples of the repeating unit represented by the foregoing general formula (I) include those represented by the following formulae (I-1) to (I-24).

TABLE 1

| No. | Repeating unit |
|---|---|
| I-1 | 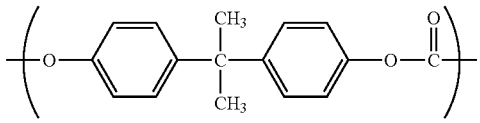 |
| I-2 | 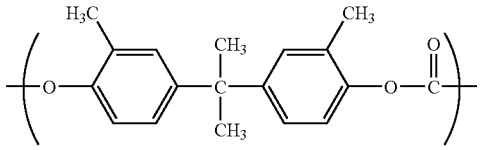 |
| I-3 | 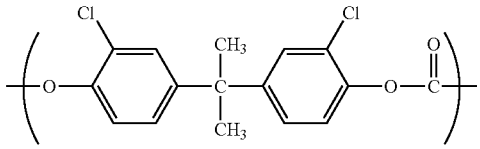 |
| I-4 | 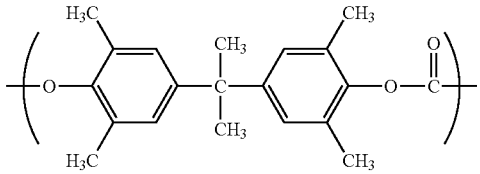 |

TABLE 1-continued
| No. | Repeating unit |
|---|---|
| I-5 | 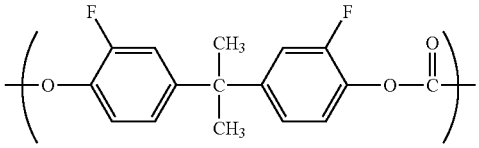 |
| I-6 | 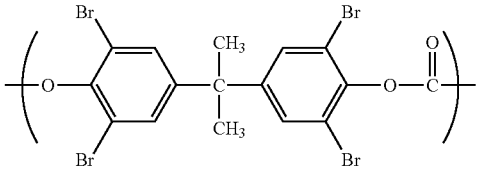 |
| I-7 | 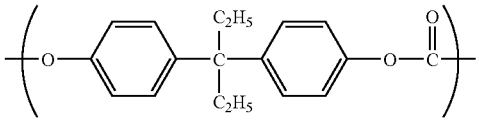 |
TABLE 2
| No. | Repeating unit |
|---|---|
| I-8 | 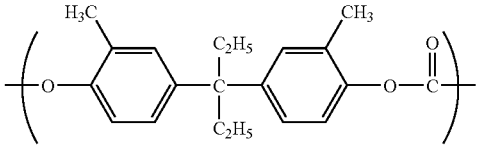 |
| I-9 | 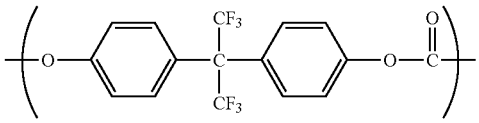 |
| I-10 | 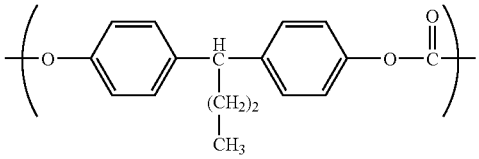 |
| I-11 | 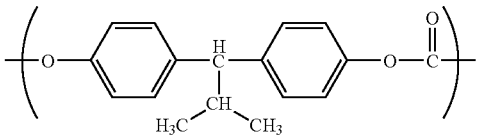 |
| I-12 | 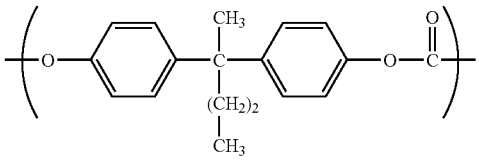 |
TABLE 2-continued
| No. | Repeating unit |
|---|---|
| I-13 | 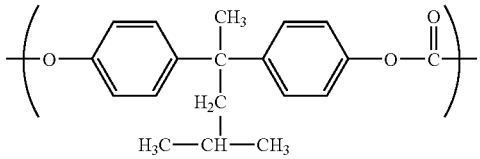 |
| I-14 | 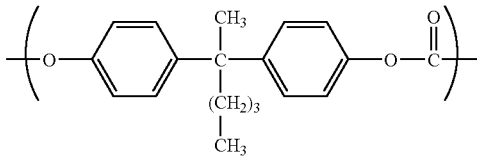 |
TABLE 3
| No. | Repeating unit |
|---|---|
| I-15 | 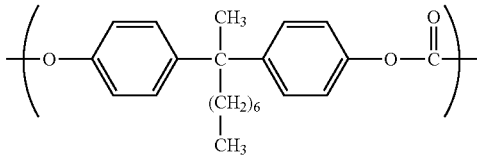 |
| I-16 | 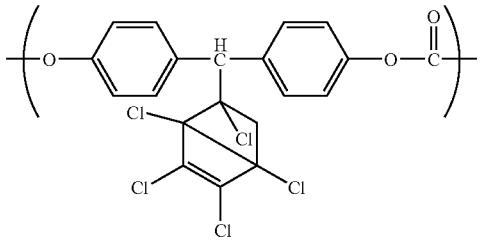 |
| I-17 | 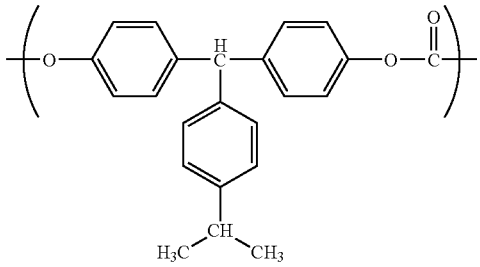 |
| I-18 | 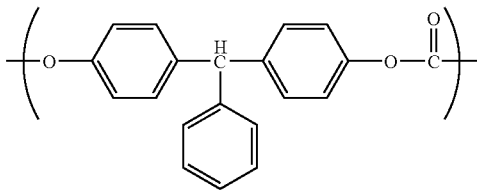 |

TABLE 3-continued
| No. | Repeating unit |
|---|---|
| I-19 | 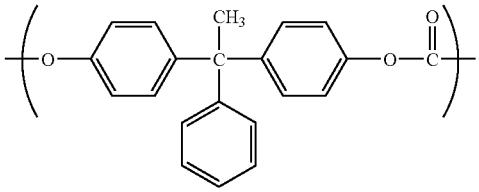 |
TABLE 4
| No. | Repeating unit |
|---|---|
| I-20 | 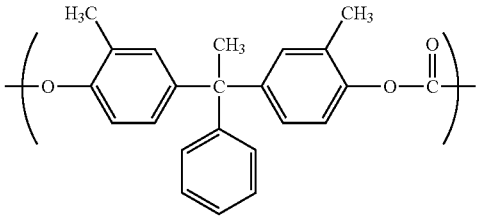 |
| I-21 | 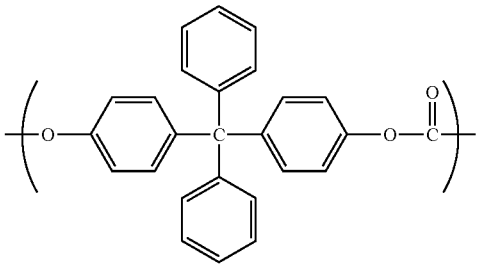 |
| I-22 | 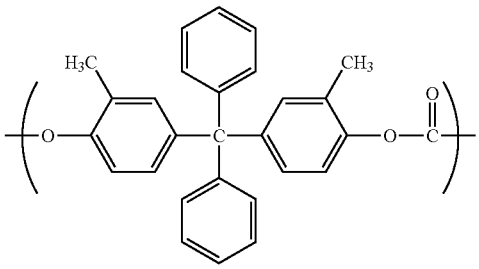 |
| I-23 | 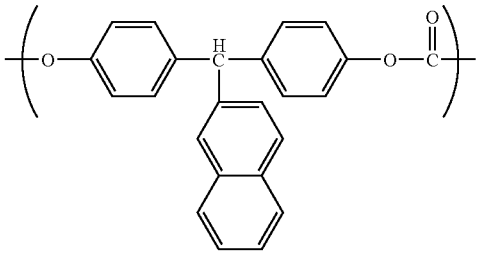 |
TABLE 4-continued
| No. | Repeating unit |
|---|---|
| I-24 | 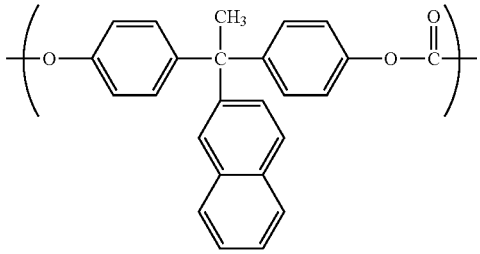 |
Specific examples of the repeating unit represented by the foregoing formula (II) include those represented by the following formulae (II-1) to (II-13).
TABLE 5
| No. | Repeating unit |
|---|---|
| II-1 | 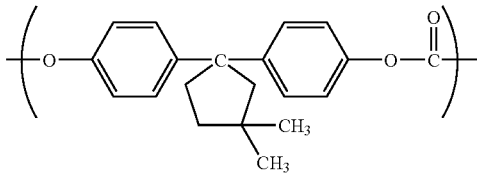 |
| II-2 | 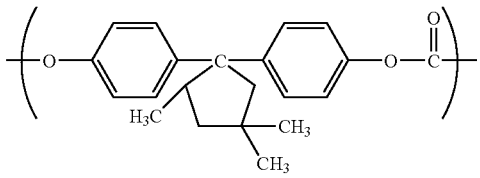 |
| II-3 | 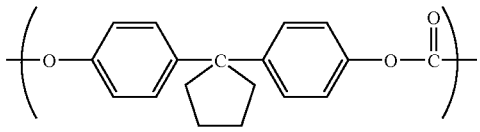 |
| II-4 | 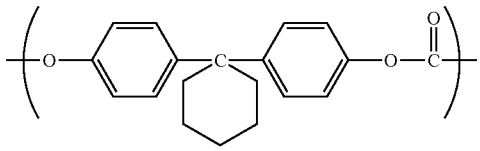 |
| II-5 | 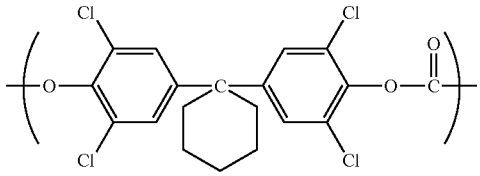 |
| II-6 | 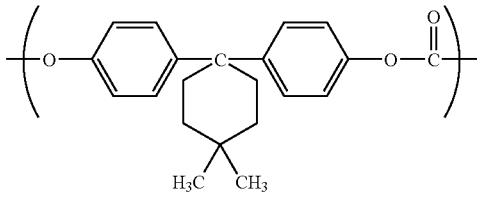 |

TABLE 6
| No. | Repeating unit |
|---|---|
| II-7 | 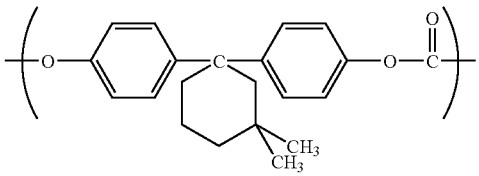 |
| II-8 | 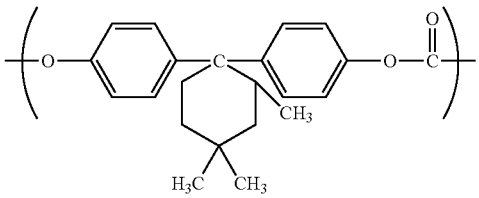 |
| II-9 | 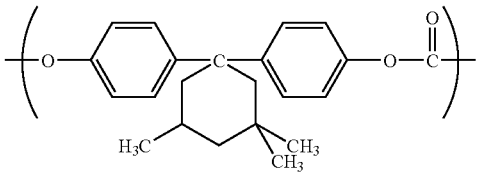 |
| II-10 | 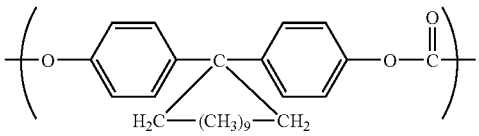 |
| II-11 | 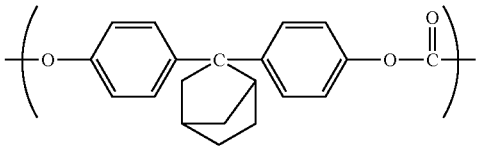 |
| II-12 | 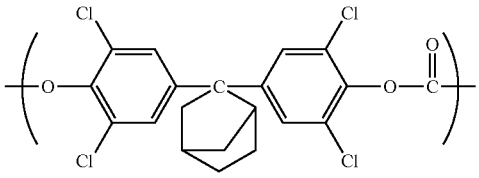 |
| II-13 | 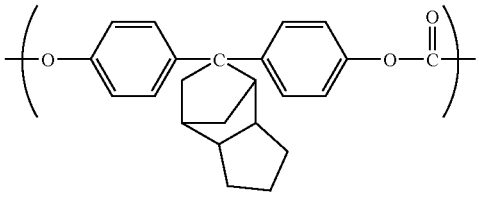 |
Specific examples of the repeating unit represented by the foregoing formula (III) include those represented by the following formulae (III-1) to (III-8).
TABLE 7
| No. | Repeating unit |
|---|---|
| III-1 | 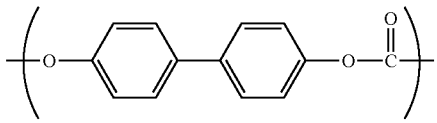 |
| III-2 | 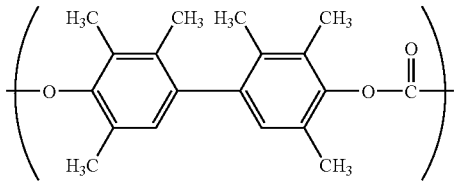 |
| III-3 | 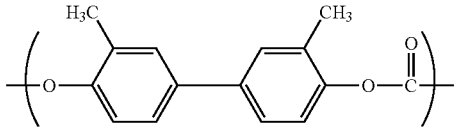 |
| III-4 | 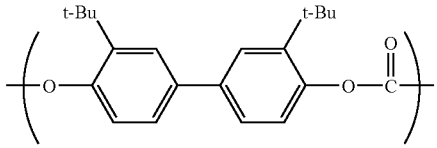 |
| III-5 | 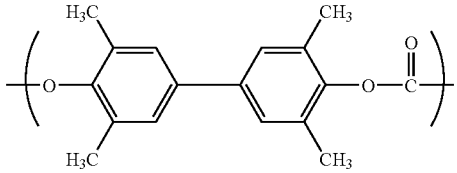 |
| III-6 | 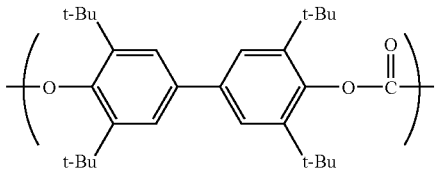 |

TABLE 8

| No. | Repeating unit |
|---|---|
| III-7 | 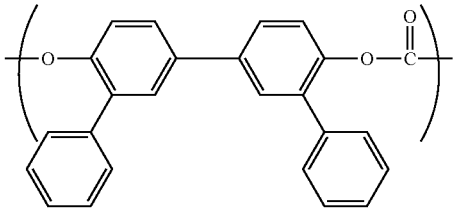 |
| III-8 | 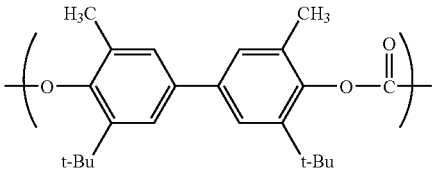 |

Specific examples of the repeating unit represented by the foregoing formula (IV) include those represented by the following formulae (IV-1) to (IV-4).

The foregoing carbonate resin as the binder resin may be a copolymer comprising a combination of the foregoing specific repeating units or a mixture of two or more kinds of homopolymers each having the foregoing repeating unit. Alternatively, the carbonate resin may be a mixture of two or more kinds of copolymers, a mixture of a homopolymer and two or more kinds of copolymers, or a mixture of two or more kinds of homopolymers and two or more kinds of copolymers.

In the copolymer having the foregoing specific repeating units, it is preferable that the repeating units selected from the group consisting of the formulae (I), (II) and (III) are contained as the major components. Also, in the case where the repeating unit represented by the formula (IV) is contained, it can be expected that an effect for enhancing the ability to prevent adhesion of the paper components increases. In the copolymer having the foregoing repeating units, it is preferred to use the repeating units selected form the group consisting of the formulae (I), (II) and (III) in an amount ranging of from 0 to 95% by mole in the copolymer and the repeating unit represented by the formula (IV) in an amount ranging of from 0 to 40% by mole in the copolymer.

Also, it is preferred to use a copolymer having one or more kinds of a repeating unit selected from the group formula (I), (II) or (III) and a repeating unit represented by the formula (IV) and/or a mixture of one or more kinds of

TABLE 9

| No. | Repeating unit |
|---|---|
| IV-1 | 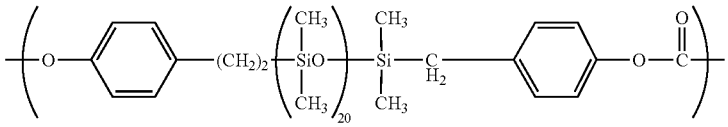 |
| IV-2 | 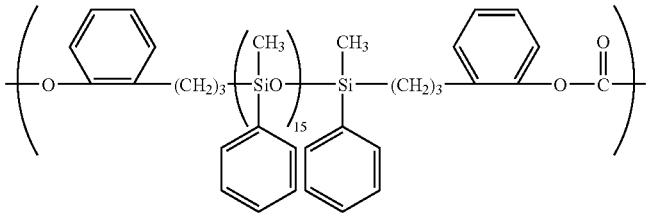 |
| IV-3 | 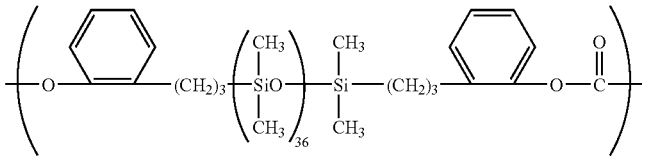 |
| IV-4 | 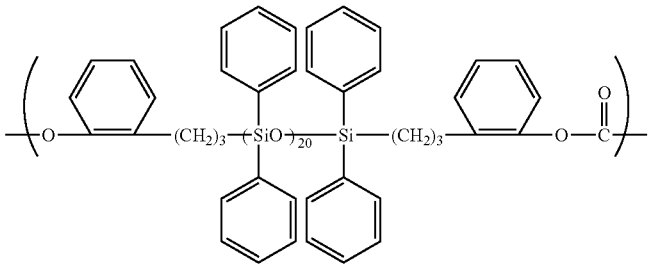 |

homopolymers having a repeating unit selected from the group consisting of the formula (I), (II) or (III) and a homopolymer having a repeating unit represented by the formula (IV) as the binder resin. Also, of the copolymers, a copolymer having repeating units selected from the group consisting of formulae (I), (II) and (IV) and a copolymer having repeating units selected from the group consisting of formulae (II), (III) and (IV) are more preferable. By using such a copolymer, it is possible to keep not only the charge potential of the electrophotographic photoreceptor but also the potential of the electrophotographic photoreceptor after the exposure at fixed levels.

Also, other examples of the binder resin include those containing a polymer having one or more kinds of a repeating unit represented by the following formula (V), (VI), (VII) or (VIII).

In the formula (V), $W_1$ represents a divalent organic group having an aromatic ring; $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; and $k_1$ and $k_2$ each represents an integer of from 0 to 4.

(V)

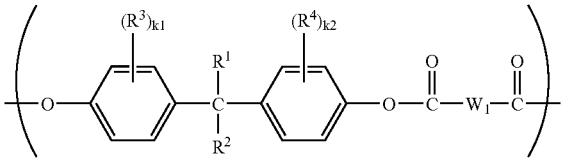

In the formula (VI), $W_2$ represents a divalent organic group having an aromatic ring; X represents a divalent organic group having a single ring or multiple rings; $R^5$ and $R^6$ each independently represents a halogen atom or a substituted or unsubstituted hydrocarbon group; and $k_3$ and $k_4$ each represents an integer of from 0 to 4.

(VI)

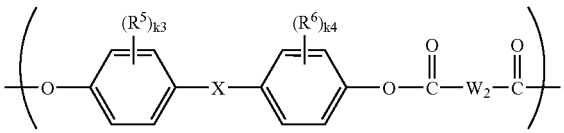

In the formula (VII), $W_3$ represents a divalent organic group having an aromatic ring; $R^7$ and $R^8$ each independently represents a halogen atom or a substituted or unsubstituted hydrocarbon group; and $k_5$ and $k_6$ each represents an integer of from 0 to 4.

(VII)

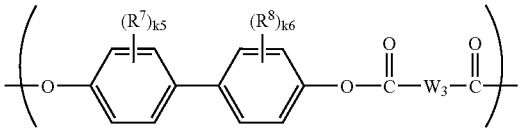

In the formula (VIII), $W_4$ represents a divalent organic group having an aromatic ring; $Y_1$ and $Y_2$ each independently represents an alkylene group; $R^9$ to $R^{12}$ each independently represents a hydrogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $k_7$ and $k_8$ each represents an integer of from 0 to 4; and n represents an integer of from 0 to 150.

(VIII)

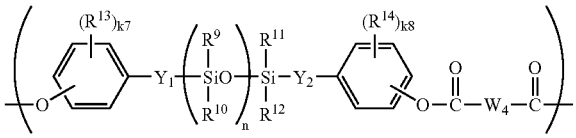

In the foregoing formula (V), examples of the divalent organic group having an aromatic ring represented by $W_1$ include an arylene group. Specific examples of the arylene group include arylene groups represented by the following formulae (IX-1) to (IX-8). Of these, a phenylene group is preferable.

TABLE 10

| No. | Chemical formula |
|---|---|
| IX-1 | 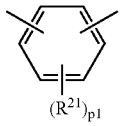 |
| IX-2 | 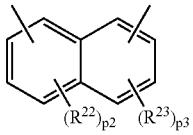 |
| IX-3 | 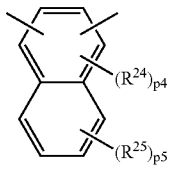 |
| IX-4 | 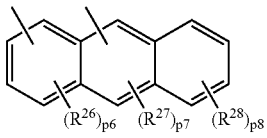 |
| IX-5 | 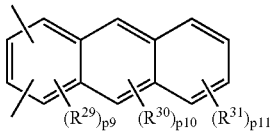 |
| IX-6 | 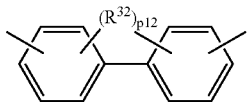 |

TABLE 10-continued

| No. | Chemical formula |
|---|---|
| IX-7 | 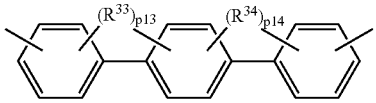 |
| IX-8 | 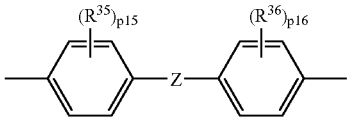 |

In the foregoing formulae (IX-1) to (IX-8), $R^{21}$ to $R^{31}$ and $R^{35}$ to $R^{36}$ each represents an alkyl group (more preferably an alkyl group having from 1 to 10 carbon atoms), an aryl group (preferably an aryl group having from 1 to 20 carbon atoms), or a substituent containing a silicon atom or a fluorine atom (preferably an organic group containing a silicon atom or a fluorine atom, and more preferably —Si(Me)$_3$ or —CF$_3$); $R^{32}$ to $R^{34}$ each represents a substituted or unsubstituted alkylene group (more preferably an alkylene group having from 1 to 10 carbon atoms); Z represents a substituted or unsubstituted alkylene group (more preferably an alkylene group having from 1 to 20 carbon atoms), an arylene group (more preferably an arylene group having from 6 to 20 carbon atoms), a divalent group containing a silicon atom or a fluorine atom, a divalent group represented by the following formula (X-1), or a divalent group represented by the following formula (X-2); p1, p5, p8, p11, p15, and p16 each represents an integer of from 0 to 4; p2, p3, and p6 each represents an integer of from 0 to 3; p4, p9, p10, and p12 to p14 each represents an integer of from 0 to 2; and p7 represents an integer of from 0 to 1.

(X-1)

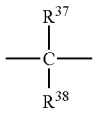

(X-2)

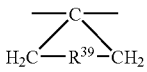

In the foregoing formula (X-1), $R^{37}$ and $R^{38}$ each represents a hydrogen atom, an alkyl group (more preferably an alkyl group having from 1 to 10 carbon atoms), an aryl group (preferably an aryl group having from 1 to 20 carbon atoms), or —CF$_3$. In the foregoing formula (X-2), $R^{39}$ represents an alkylene group (more preferably an alkylene group having from 1 to 10 carbon atoms).

In the foregoing formula (V), the unsubstituted hydrocarbon group represented by $R^1$ and $R^2$ is preferably an aliphatic hydrocarbon group or an aromatic hydrocarbon group; and more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms). Also, the substituted hydrocarbon group is preferably one substituted with a halogen atom or the foregoing linear or branched alkyl group. Also, the substituted heterocyclic group is preferably one substituted with a halogen atom or the foregoing linear or branched alkyl group.

In the foregoing formula (V), the unsubstituted hydrocarbon group represented by $R^3$ and $R^4$ is preferably an aliphatic hydrocarbon group or an aromatic hydrocarbon group; and more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms). Also, the substituted hydrocarbon group is preferably one substituted with a halogen atom or the foregoing linear or branched alkyl group.

In the foregoing formula (VI), examples of the divalent organic group having an aromatic ring represented by $W_2$ include those enumerated in $W_1$. The single ring or multiple rings in the divalent organic group having a single ring or multiple rings represented by X may be a hydrocarbon ring group or a heterocyclic group. Incidentally, as the heterocyclic group, the same unsubstituted heterocyclic groups as in $R^1$ and $R^2$ can be enumerated. The divalent organic group represented by X is more preferably any one selected from the following (XI-1) to (XI-5).

TABLE 11

| No. | Chemical formula |
|---|---|
| XI-1 | 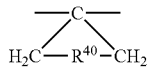 |
| XI-2 | 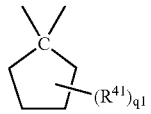 |
| XI-3 | 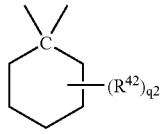 |
| XI-4 | 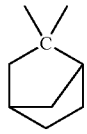 |
| XI-5 | 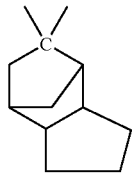 |

In the foregoing formula (XI-1), $R^{40}$ represents an alkylene group (preferably an alkylene group having from 1 to 15 carbon atoms). In the foregoing formula (XI-2), $R^{41}$ represents a hydrocarbon group (preferably an alkyl group having from 1 to 6 carbon atoms); and q1 represents an integer of from 1 to 8. In the foregoing formula (XI-3), $R^{42}$ represents a hydrocarbon group (preferably an alkyl group having from 1 to 6 carbon atoms); and q2 represents an integer of from 1 to 10.

Preferred examples of $R^5$ and $R^6$ in the foregoing formula (VI) and preferred examples of $R^7$ and $R^8$ in the foregoing formula (VII) are the same as in $R^3$ and $R^4$ in the foregoing formula (V). Also, in the foregoing formula (VII), examples of the divalent organic group having an aromatic ring represented by $W_3$ include those enumerated in $W_1$.

In the foregoing formula (VIII), examples of the divalent organic group having an aromatic ring represented by $W_4$ include those enumerated in $W_1$. In the foregoing formula (VIII), $Y_1$ and $Y_2$ are preferably an alkylene group having from 1 to 6 carbon atoms; and the unsubstituted hydrocarbon group represented by $R^9$ to $R^{12}$ is preferably an aliphatic hydrocarbon group or an aromatic hydrocarbon group, more preferably a linear or branched alkyl group (preferably an alkyl group having from 1 to 6 carbon atoms), a cycloalkyl group (preferably a cycloalkyl group having from 3 to 6 carbon atoms), or an aryl group (preferably an aryl group having from 6 to 12 carbon atoms), and further preferably a methyl group or a phenyl group. Also, the substituted hydrocarbon group is preferably one substituted with a halogen atom or the foregoing linear or branched alkyl group. As the substituted or unsubstituted heterocyclic group represented by $R^9$ to $R^{12}$, the same as in $R^1$ and $R^2$ in the foregoing formula (V) can be enumerated. Preferred examples of $R^{13}$ and $R^{14}$ in the foregoing formula (VIII) are those enumerated for $R^3$ and $R^4$ in the foregoing formula (V).

Specific examples of the repeating unit represented by the foregoing general formula (V) include those represented by the following formulae (V-1) to (V-24). Incidentally, in the following formulae, the position of carbon of the carbonyl group bound to the benzene ring in the right end may be any of the o-position, m-position or p-position. Also, examples of the polymer having a repeating unit represented by the foregoing formula (V) may be a homopolymer having a repeating unit represented by the formula (V-1) in which carbon of the carbonyl group is bound at the m-position of the benzene ring and a copolymer having a repeating unit represented by the formula (V-1) in which carbon of the carbonyl group is bound at the m-position of the benzene ring and a repeating unit represented by the formula (V-1) in which carbon of the carbonyl group is bound at the p-position of the benzene ring. The same is applicable with respect to polymers having a repeating unit represented by the general formula (VI), (VII) or (VIII).

TABLE 12

| No. | Repeating unit |
|---|---|
| V-1 | 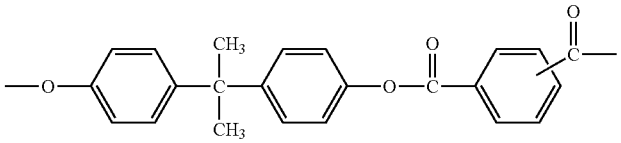 |
| V-2 | 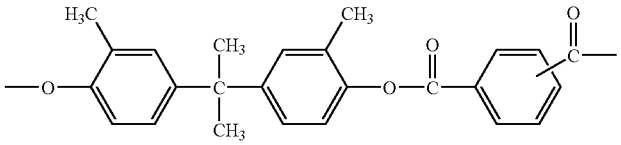 |
| V-3 | 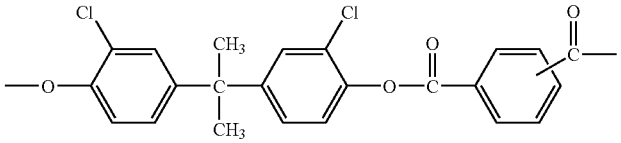 |
| V-4 | 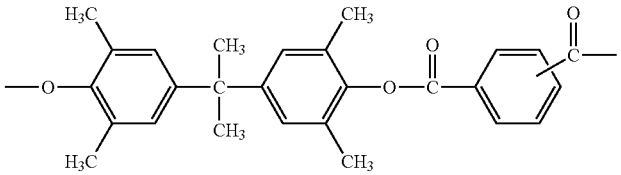 |
| V-5 | 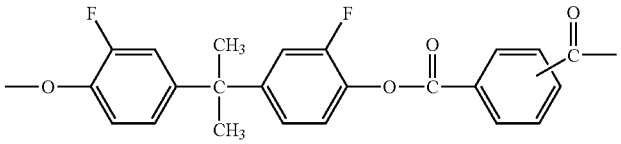 |
| V-6 | 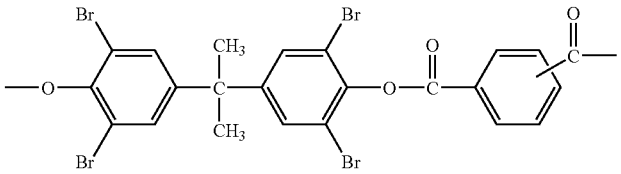 |

TABLE 12-continued
| No. | Repeating unit |
|---|---|
| V-7 | 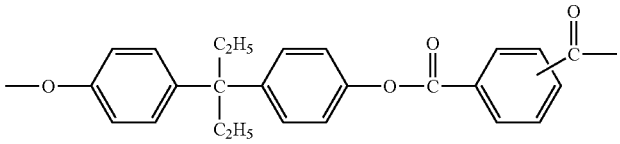 |
TABLE 13
| No. | Repeating unit |
|---|---|
| V-8 | 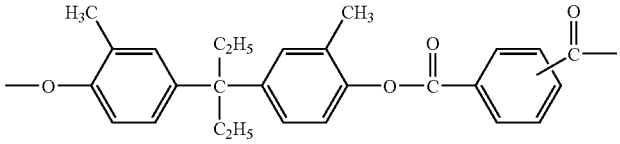 |
| V-9 | 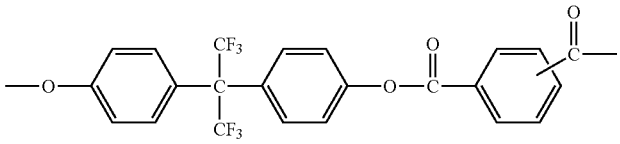 |
| V-10 | 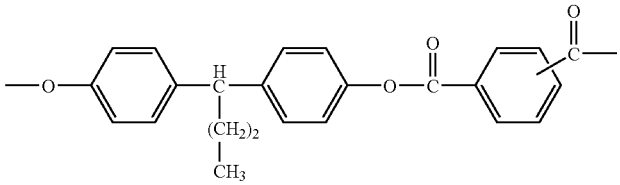 |
| V-11 | 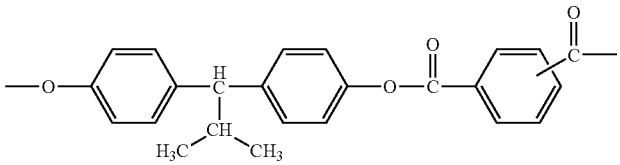 |
| V-12 | 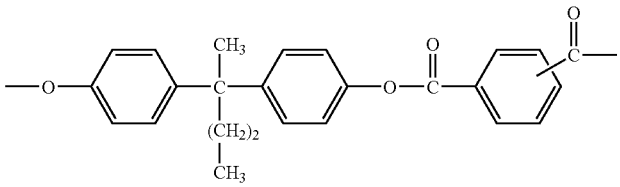 |

TABLE 13-continued
| No. | Repeating unit |
|---|---|
| V-13 | 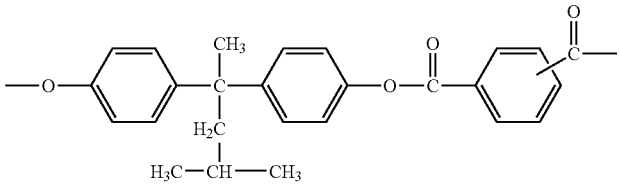 |
| V-14 | 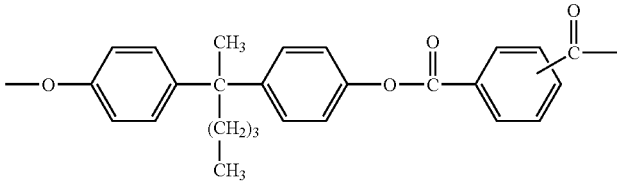 |
TABLE 14
| No. | Repeating unit |
|---|---|
| V-15 | 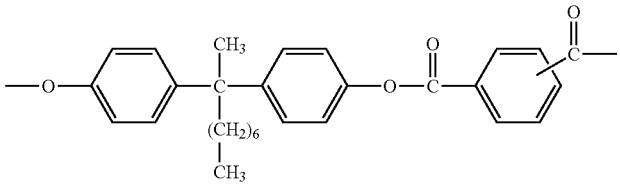 |
| V-16 | 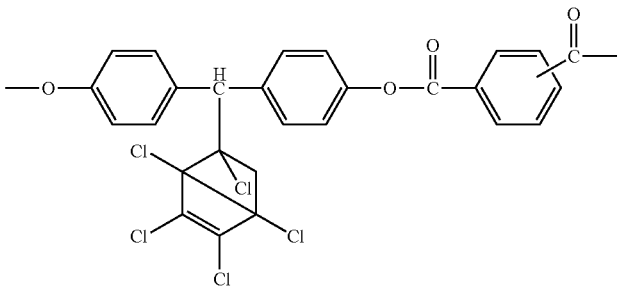 |
| V-17 | 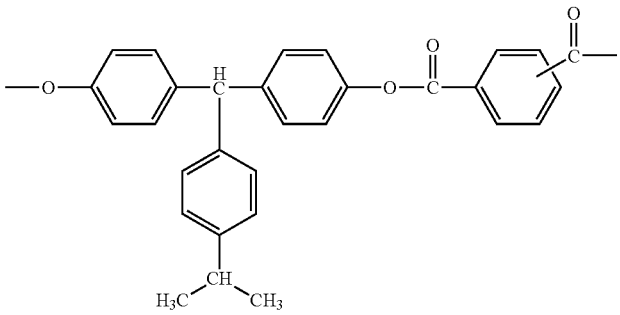 |

TABLE 14-continued
| No. | Repeating unit |
|---|---|
| V-18 | 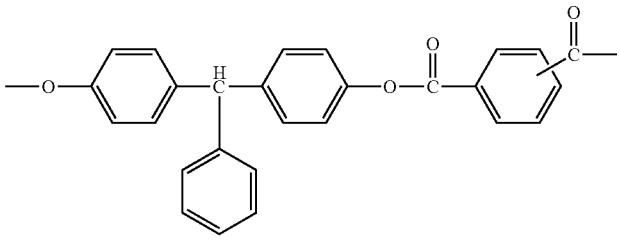 |
| V-19 | 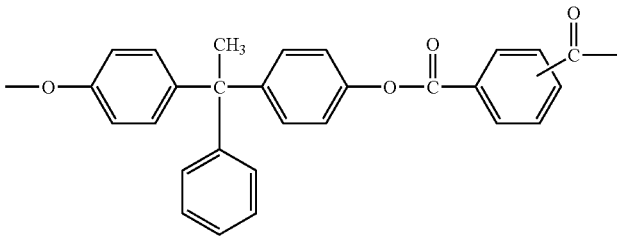 |
TABLE 15
| No. | Repeating unit |
|---|---|
| V-20 | 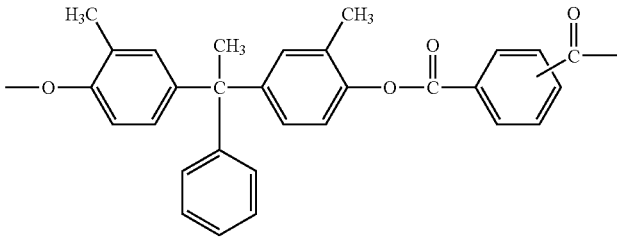 |
| V-21 | 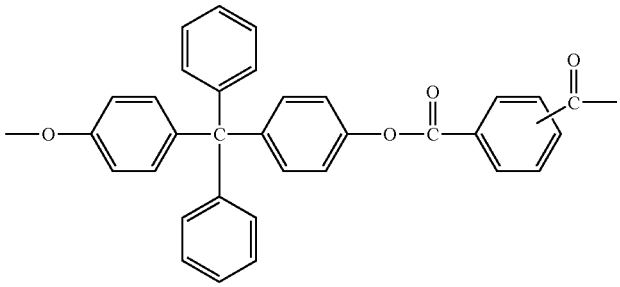 |
| V-22 | 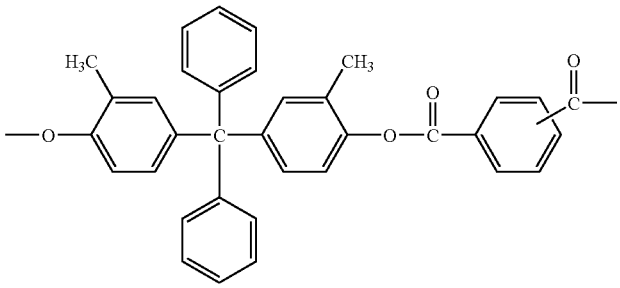 |

TABLE 15-continued
| No. | Repeating unit |
|---|---|
| V-23 | 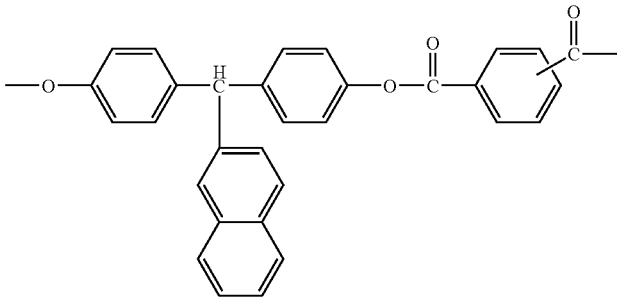 |
| V-24 | 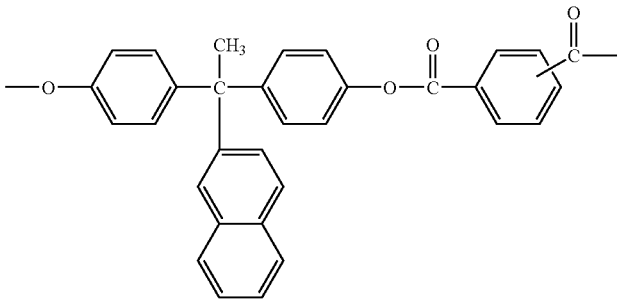 |
Specific examples of the repeating unit represented by the foregoing formula (VI) include those represented by the following formulae (VI-1) to (VI-13).
TABLE 16
| No. | Repeating unit |
|---|---|
| VI-1 | 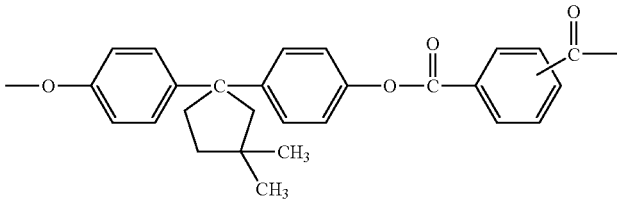 |
| VI-2 | 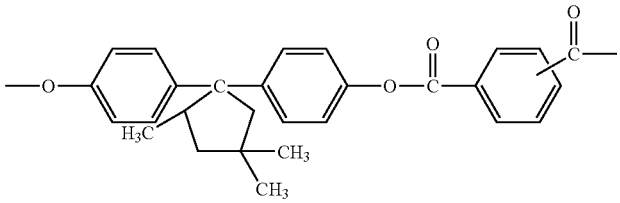 |
| VI-3 | 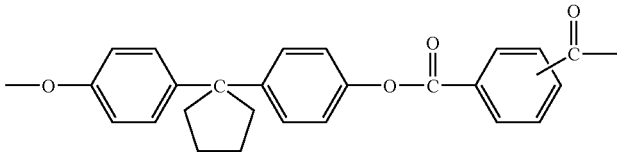 |

TABLE 16-continued
| No. | Repeating unit |
|---|---|
| VI-4 | 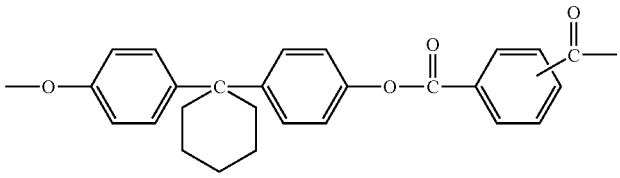 |
| VI-5 | 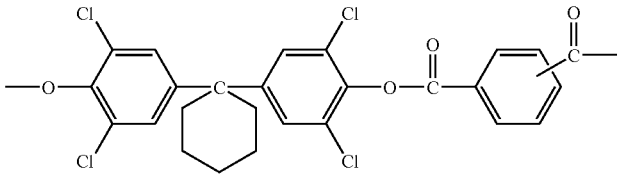 |
| VI-6 | 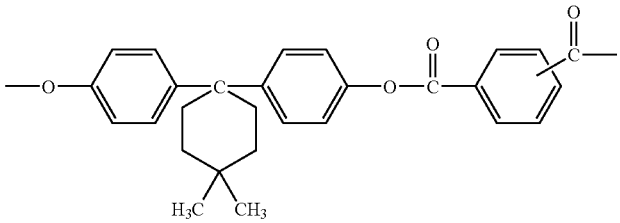 |
TABLE 17
| No. | Repeating unit |
|---|---|
| VI-7 | 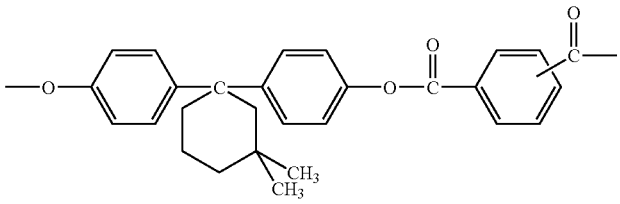 |
| VI-8 | 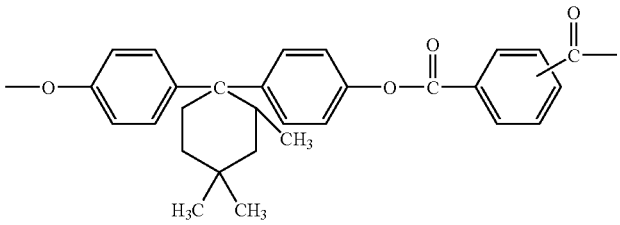 |
| VI-9 | 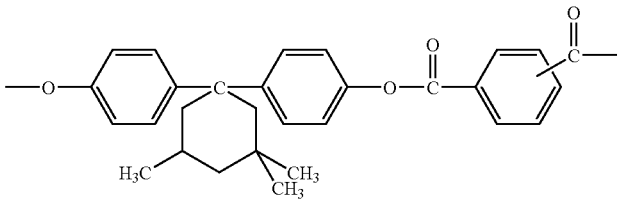 |
| VI-10 | 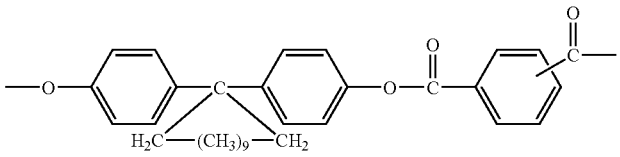 |

TABLE 17-continued
| No. | Repeating unit |
|---|---|
| VI-11 | 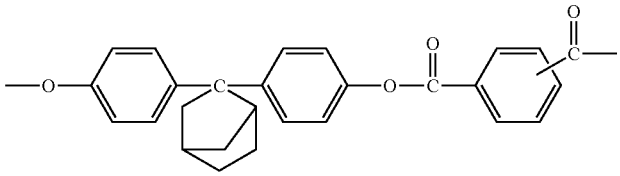 |
| VI-12 | 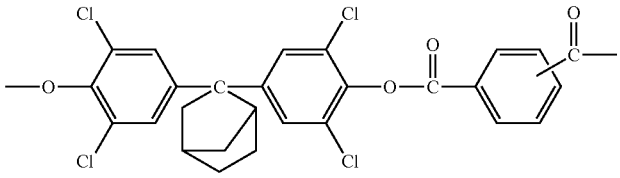 |
| VI-13 | 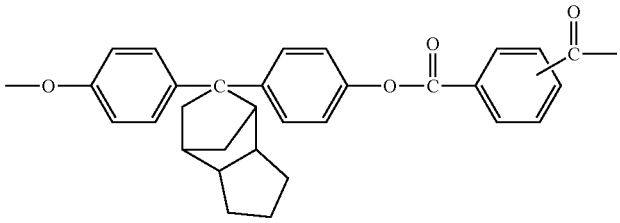 |
Specific examples of the repeating unit represented by the foregoing formula (VII) include those represented by the following formulae (VII-1) to (VII-8). Incidentally, in the following chemical formulae, the term "t-Bu" means a t-butyl group.
TABLE 18
| No. | Repeating unit |
|---|---|
| VII-1 | 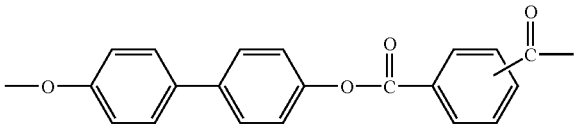 |
| VII-2 | 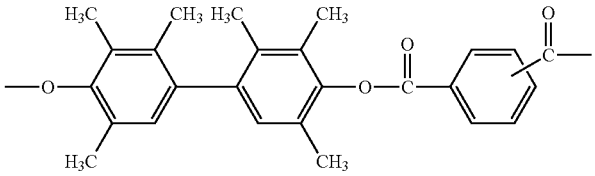 |
| VII-3 | 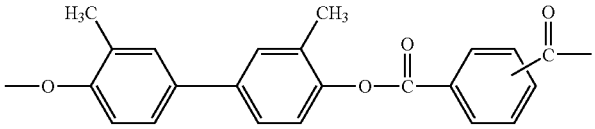 |
| VII-4 | 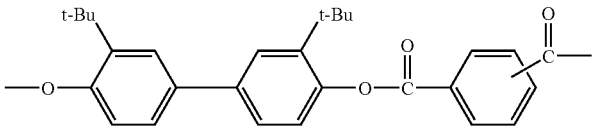 |

TABLE 19
| No. | Repeating unit |
|---|---|
| VII-5 | 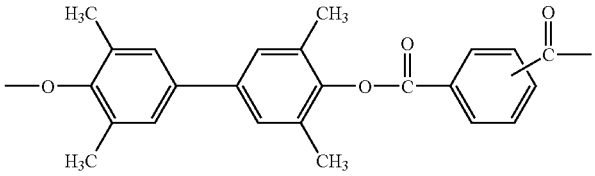 |
| VII-6 | 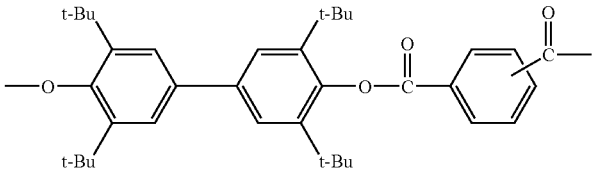 |
| VII-7 | 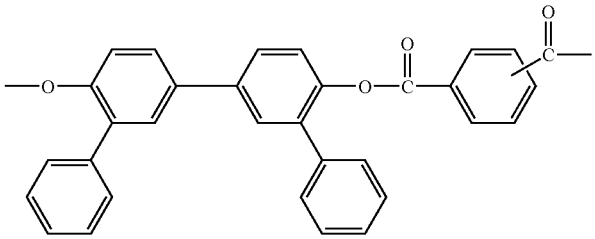 |
| VII-8 | 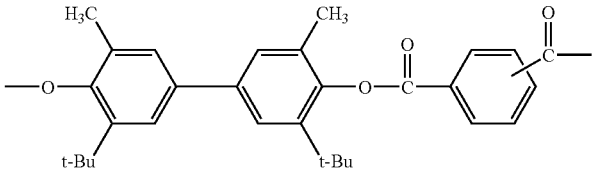 |
Specific examples of the repeating unit represented by the foregoing formula (VIII) include those represented by the following formulae (VIII-1) to (VIII-4).
TABLE 20
| No. | Repeating unit |
|---|---|
| VIII-1 | 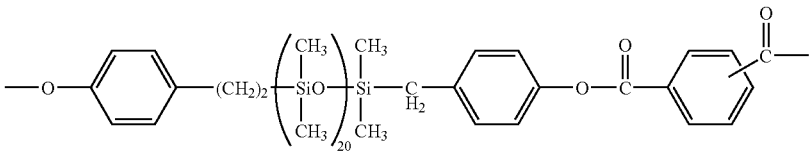 |
| VIII-2 | 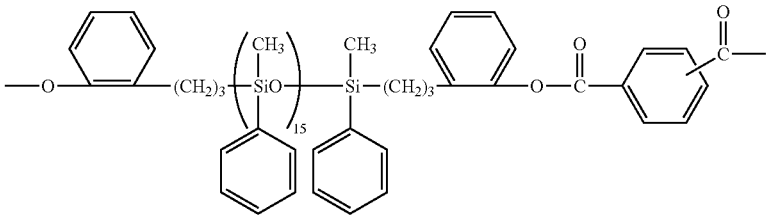 |

TABLE 20-continued

| No. | Repeating unit |
|---|---|
| VIII-4 | 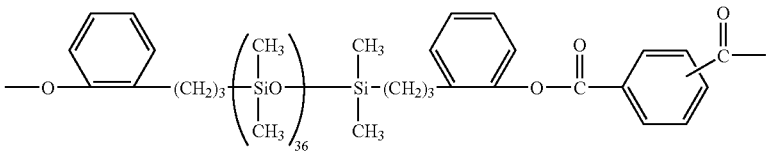 |
| VIII-4 | 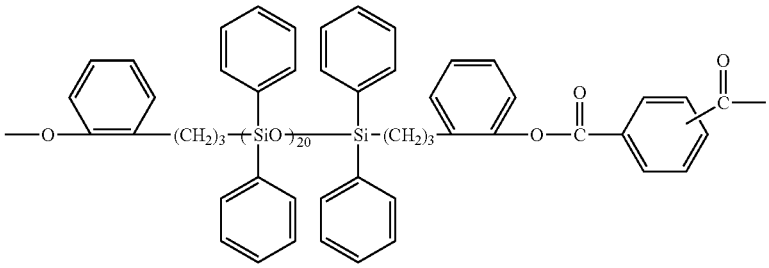 |

The foregoing arylate resin as the binder resin may be a homopolymer having the foregoing specific repeating unit or a copolymer comprising a combination of the foregoing specific repeating units. Also, the arylate resin may be a mixture of two or more kinds of homopolymers each having foregoing specific repeating unit, a mixture of two or more kinds of copolymers, a mixture of a homopolymer and two or more kinds of copolymers, or a mixture of two or more kinds of homopolymers and two or more kinds of copolymers.

In the copolymer having the foregoing specific repeating units, it is preferable that the repeating units represented by the formulae (V) and/or (VI) are contained as the major components. Also, in the case where the repeating units represented by the general formulae (VII) and/or (VIII) are contained, it can be expected that the abrasion resistance and an effect for enhancing the ability to prevent adhesion of the paper components increase. In the copolymer having the foregoing repeating units, it is preferred to use the repeating units represented by the formulae (V) and/or (VI) in an amount ranging from 0 to 95% by mole in the copolymer and the repeating units represented by the formulae (VII) and/or (VIII) in an amount ranging from 0 to 50% by mole in the copolymer.

Also, it is preferred to use a copolymer having one or more kinds of a repeating unit represented by the formula (V), (VI) or (VII) and a repeating unit represented by the formula (VIII) and/or a mixture of one or more kinds of homopolymers having a repeating unit represented by the formula (V), (VI) or (VII) and a homopolymer having a repeating unit represented by the formula (VIII) as the binder resin. Also, of the copolymers, a copolymer having repeating units represented by the formulae (V), (VI) and (VIII) and a copolymer having repeating units represented by the formulae (VI), (VII) and (VIII) are more preferable. By using such a copolymer, it is possible to keep not only the charge potential of the electrophotographic photoreceptor but also the potential of the electrophotographic photoreceptor after the exposure at fixed levels.

Also, as the binder resin to be used in the charge transport layer, other arbitrary resins can be used together with the carbonate resin or arylate resin. However, resins having an affinity with the charge transport material and an adequate strength are desirable. Examples of other binder resins include polyester resins, methacrylic resins, acrylic resins, polyvinyl chloride resins, polyvinylidene chloride resins, polystyrene resins, polyvinyl acetate resins, styrene-butadiene copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene-acrylic copolymer resins, styrene-alkyd resins, poly-N-vinylcarbazole resins, polyvinyl butyral resins, and polyphenylene ether resins.

These resins can be used singly or in combination of two or more thereof.

The molecular weight of the foregoing binder resin is properly chosen depending upon film formation conditions such as film thickness and solvent, but in general, is preferably from 3,000 to 300,000, and more preferably from 20,000 to 200,000 in terms of viscosity average molecular weight.

The charge transport layer 6 can be formed by coating a coating solution for forming a charge transport layer comprising the foregoing charge transport material and binder resin dissolved in a proper solvent on the charge generation layer and drying it. Also, the charge transport layer 6 may be formed by coating a coating solution for forming a charge transport layer comprising the foregoing fluorine based resin fine particles, charge transport material and binder resin dissolved in a proper solvent on the charge generation layer and drying it.

Here, the compounding ratio of the charge transport material to the binder resin is preferably from 10/1 to 1/5.

Examples of the solvent to be used in the coating solution for forming a charge transport layer include aromatic hydrocarbon based solvents (for example, benzene, toluene, and chlorobenzene), ketones (for example, acetone and 2-butanone), halogenated aliphatic hydrocarbons (for example, methylene chloride, chloroform, and ethylene chloride), cyclic or linear ethers (for example, tetrahydrofuran, dioxane, ethylene glycol, and diethyl ether), and mixed solvents thereof.

Also, for the sake of enhancing the smoothness of a coating film, a trace amount of silicone oil can be added as a leveling agent in the coating solution.

Also, it is preferable that the charge transport layer 6 contains inorganic particles in addition to the fluorine based resin fine particles. In preparing the coating solution for forming a charge transport layer, since the inorganic particles function as a dispersing agent, the fluorine based resin fine particles are more uniformly dispersed in the layer, whereby the effects of the invention can be further enhanced.

Examples of the inorganic particles include inorganic particles made of alumina, silica (silicon dioxide), titanium oxide, zinc oxide, cerium oxide, zinc sulfide, magnesium oxide, copper sulfate, sodium carbonate, magnesium sulfate, potassium chloride, calcium chloride, sodium chloride, nickel sulfate, antimony oxide, manganese dioxide, chromium oxide, tin oxide, zirconium oxide, barium sulfate, aluminum sulfate, silicon carbide, titanium carbide, boron carbide, tungsten carbide, and zirconium carbide. These compounds can be used singly or in combination of two or more thereof. Of these, particles made of silica are preferable.

As the silica particles, those prepared by the chemical flame CVD method are preferable. Concretely, a method in which a chlorosilane gas is subjected to vapor phase reaction in a high-temperature flame of an oxygen-hydrogen mixed gas or a hydrocarbon-oxygen mixed gas is preferable.

Also, as the inorganic particles, particles the surfaces of which have been made hydrophobic are preferable. Examples of treating agents to be used for the hydrophobic treatment include siloxane compounds, silane coupling agents, titanium coupling agents, and high-molecular fatty acids or metal salts thereof.

Examples of siloxane coupling agents include polydimethylsiloxane, dihydroxypolysiloxane, and octamethylcyclotetrasiloxane. Also, examples of silane coupling agents include γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, hexamethyldisilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, and p-methylphenyl trimethoxysilane.

Also, the inorganic particles preferably have a primary particle size of from 0.005 to 2.0 μm, and more preferably from 0.01 to 1.0 μm. When the primary particle size of the inorganic particles is less than 0.005 μm, a sufficient mechanical strength on the photoreceptor surface tends to be hardly obtained, and coagulation is liable to occur at the time of dispersion. On the other hand, when it exceeds 2.0 μm, the surface roughness of the photoreceptor becomes large, and a cleaning blade is worn down and injured to cause deterioration of cleaning characteristics, whereby image blur is liable to occur.

With respect to the method of dispersing the fluorine based resin fine particles, media dispersion machines such as a ball mill, a vibration mill, an attritor, a sand mill, and a horizontal sand mill, and medialess dispersion machines such as an agitator, an ultrasonic dispersion machine, a roll mil, and a high-pressure homogenizer can be utilized. Further, examples of the high-pressure homogenizer include a collision mode in which the dispersion liquid is subjected to liquid-liquid collision or liquid-wall collision in the high-pressure state and dispersed and a penetration mode in which the dispersion liquid is penetrated into a fine passage and dispersed.

As the method of dispersing the coating solution for forming the charge transport layer 6 having releasable solid particles dispersed therein, a method in which the fluorine based resin fine particles and the inorganic particles are dispersed in a coating solution containing the binder resin, the charge transport material, etc. dissolved in a solvent is employed.

Also, for the sake of enhancing the dispersion stability of the respective particles in the coating solution (dispersion liquid) and preventing coagulation at the time of forming a coating film, it is effective to add a small amount of a dispersing agent. Examples of dispersing agents include fluorine based surfactants, fluorine based polymers, silicone based polymers, and silicone oils. The fluorine based polymers as referred to herein mean a polymer containing a fluorine atom.

Of these, fluorine based polymers, especially fluorine based graft polymers (for example, fluorine based comb-type graft polymers) are effective as the dispersing agent. Also, as the fluorine based comb-type graft copolymers, resins graft polymerized from a macro monomer made of an acrylic acid ester compound, a methacrylic acid ester compound, a styrene compound, etc. and a perfluoroalkylethyl methacrylate are preferable. The addition amount of the dispersing agent is suitably from 0.01 to 5% by weight based on the solids content of the coating solution. By jointly using such a dispersing agent, the fluorine based resin fine particles are more uniformly dispersed in the layer, whereby the effect of the invention can be more sufficiently obtained while keeping the electrophotographic characteristics at high levels.

Also, for the purposes of preventing deterioration of the photoreceptor due to ozone or oxidative gases generated in an electrophotographic device or light or heat, additives such as antioxidants, light stabilizers, and heat stabilizers can be added in the photosensitive layer.

Examples of antioxidants include hindered phenols, hindered amines, p-phenylenediamine, arylalkanes, hydroquinone, spirochroman, spiroindanone, and derivatives thereof, organosulfur compounds, and organophosphorus compounds.

As the antioxidant, examples of phenol-based antioxidants include 2,6-di-t-butyl-4-methylphenol, styrenated phenol, n-octadecyl-3-(3',5'-di-t-butyl-4'-hydroxyphenyl) propionate, 2,2'-methylene-bis(4-methyl-6-t-butylphenol), 2-t-butyl-6-(3'-t-butyl-5'-methyl-2'-hydroxybenzyl)-4-methylphenyl acrylate, 4,4'-butylidene-bis (3-methyl-6-t-butylphenol), 4,4'-thio-bis(3-methyl-6-t-butylphenol), 1,3,5-tris(4-t-butyl-3-hydroxy-2,6-dimethylbenzyl) isocyanurate, tetrakis-[methylene-3-(3',5'-di-t-butyl-4'-hydroxyphenyl) propionato]-methane, 3,9-bis-[2-[3-(3-t-butyl-4-hydroxy-5-methylphenyl)propionyloxy]-1,1-dimethylethyl]-2,4,8,10-tetraoxapyro[5,5]undecane, and stearyl 3-3',5'-di-t-butyl-4'-hydroxyphenyl)propionate.

Examples of hindered amine based compounds include bis(2,2,6,6-tetramethyl-4-piperidyl) sebacate, bis-(1,2,2,6,6-pentamethyl-4-piperidyl) sebacate, 1-[2-[3-(3,5-di-t-butyl-4-hydroxyphenyl)propionyloxy]-ethyl]-4-[(3,5-di-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]-undecane-2,4-dione, 4-benzoyloxy-2,2,6,6-tetramethylpiperidine, succinic acid-dimethyl-1-(2-hydroxyethyl)-4-hydroxy-2,2,6,6-tetramethylpiperidine polycondensate, poly{[6-(1,1,3,3-tetramethylbutyl)imino-1,3,5-triazine-2,4-diyl]{(2,2,6,6-tetramethyl-4-piperidyl)imino}-hexamethylene{(2,3,6,6-tetramethyl-4-piperizyl)imino}}, 2-(3,5-di-t-butyl-4-hydroxybenzyl)-2-n-butylmalonic acid bis(1,2,2,6,6-pentamethyl-4-piperidyl), and N,N'-bis-(3-aminopropyl)ethylenediamine-2.4-bis[N-butyl-N-(1,2,2,6,6-pentamethyl-4-piperidyl)-amino]-6-chloro-1,3,5-triazine condensate.

Examples of organosulfur based antioxidants include dilauryl-3,3'-thiodipropionate, dimyristyryl-3,3'-thiodipropionate, distearyl-3,3'-thiodipropionate, penta-erythritol-tetrakis-(β-lauryl-thiopropionate), ditridecyl-3,3'-thiodipropionate, and 2-mercaptobenzimidazole.

Examples of organophosphorus based antioxidants include trisnonylphenyl phosphate, triphenyl phosphate, and tris-(2,4-di-t-butylphenyl) phosphate.

An organosulfur based or organophosphorus based antioxidant is called a secondary antioxidant, and when used together with a phenol based or amine based primary antioxidant, a synergistic effect can be obtained.

Examples of light stabilizers include benzophenone based, benzotriazole based, dithiocarbamate based, and tetramethylpiperidine based derivatives.

Examples of benzophenone based light stabilizers include 2-hydroxy-4-methoxybenzophenone, 2-hydroxy-4-octoxybenzophenone, and 2,2'-dihydroxy-4-methoxybenzophenone.

Examples of benzotriazole based light stabilizer include 2-(2'-hydroxy-5'-methylphenyl)-benzotriazole, 2-[2'-hydroxy-3'-(3",4",5",6"-tetrahydrophthalimidomethyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotrizole, 2-(2'-hydroxy-3',5'-t-butylphenyl)-benzotriazole, 2-(2'-hydroxy-5'-t-octylphenyl)-benzotriazole, and 2-(2'-hydroxy-3',5'-di-t-amylphenyl)-benzotriazole. Examples of other compounds include 2,4-di-t-butylphenyl-3',5'-d-t-butyl-4'-hydroxybenzoate and nickel dibutyldithiocarbamate.

Also, for the purposes of enhancing the sensitivity, reducing the residual potential, and reducing the fatigue at the time of repeated use, at least one electron accepter compound can be contained. Examples of the electron accepting compound that can be used in the photoreceptor 1 include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Of these, fluorenone based or quinone based compounds and benzene derivatives having an electron withdrawing substituent such as Cl, CN, and $NO_2$ are especially preferable.

Coating of the coating solution for forming a charge transport layer on the charge generation layer can be carried out by a coating method such as an immersion coating method, a ring coating method, a spray coating method, a bead coating method, a blade coating method, a roller coating method, a knife coating method, and a curtain coating method depending upon the shape and application of the photoreceptor. It is preferable that drying is carried out by drying to touch at room temperature and then heat drying. It is desirable that heat drying is carried out at a temperature of from 30 to 200° C. for a period of time ranging from 5 minutes to 2 hours.

The charge transport layer 6 preferably has a film thickness of from 5 to 50 μm, and more preferably from 10 to 30 μm.

Also, the content of the fluorine based resin fine particles in the charge transport layer 6 is preferably from 3 to 40% by weight, and more preferably from 4 to 30% by weight based on the total weight of the charge transport layer 6. When the content of the fluorine based resin fine particles is less than 3% by weight, the modification effect due to dispersion of the fluorine based resin fine particles tends to become insufficient. On the other hand, when it exceeds 40% by weight, the light transmission property tends to lower, and an increase of the residual potential due to the repeated use tends to occur, thereby making it difficult to form the layer.

Also, the content of the inorganic particles in the charge transport layer 6 is preferably from 0.1 to 30% by weight, and more preferably from 1 to 20% by weight based on the total weight of the charge transport layer 6. When the content of the inorganic particles is less than 0.1% by weight, the modification effect due to dispersion of the inorganic particles tends to become insufficient. On the other hand, when it exceeds 30% by weight, an increase of the residual potential due to the repeated use tends to occur.

The photoreceptor 1 may be one provided with a single-layer type photosensitive layer 8 as shown in FIG. 4. This single-layer type photosensitive layer is constituted of the foregoing charge generation material and charge transport material.

The single-layer type photosensitive layer 8 can be formed by known methods. For example, it can be formed by dissolving the charge generation material, charge transport material and binder resin in a solvent to prepare a coating solution for forming a single-layer type photosensitive layer, coating the coating solution on a lower layer (the subbing layer 4 in FIG. 4), and then drying it. Also, the film thickness of the single-layer type photosensitive layer 8 is set up within the usual range.

The photoreceptor 1 may be provided with the protective layer 7 as shown in FIGS. 3 and 4. This protective layer 7 is constituted of a usually used material. Incidentally, in the case where the protective layer 7 is provided on the farthest side from the support in the photoreceptor as shown in FIGS. 3 and 4, the protective layer 7 contains at least one member selected from the foregoing fluorine based resin fine particle-containing layer, carbonate resin-containing layer and arylate resin-containing layer.

Also, the protective layer 7 can enhance the abrasion resistance of the photoreceptor, enhance the life of the photoreceptor, enhance matching with a developer, and prevent chemical change of the charge transport layer 6 at the time of charge of the electrophotographic photoreceptor.

Examples of the protective layer 7 include insulating resin layers, charge transporting protective layers made of a high-molecular compound to which charge transporting property is imparted, and resistance control type surface protective layers in which a resistance controlling agent such as metal oxides is dispersed.

The thus constituted photoreceptor can be applied to not only electrophotographic devices described later but also light-lens system copiers, laser beam printers emitting near infrared light or visible light, digital copiers, LED printers, laser facsimiles, and other electrophotographic devices. Also, the photoreceptor can be used together with a one-component based or two-component based developer. Also, according to this photoreceptor, evening in the contact charging mode using a charging roller or charging brush, good characteristics are obtained such that the generation of current leakage is small.

The coated paper to be used in this embodiment comprises a substrate having disposed on at least one side of the substrate a coated layer containing an adhesive containing latex having a glass transition temperature of 20° C. or higher and a pigment, the surface of the coated layer opposite to the substrate having a glossiness of 10% or more.

First of all, the substrate will be described below. Examples of the substrate include base papers constituted of a pulp and sheets constituted of a resin. Incidentally, as the foregoing resin, resins that are generally used for the preparation of OHP sheets, etc. can be used.

As the pulp to be used as the base paper, pulps that are usually used for a base paper of general coated papers can be used. Examples include sulfite pulps, Kraft pulps, semi-chemical pulps, chemiground pulps, ground pulps, refiner ground pulps, and thermomechanical pulps. Also, waste paper pulps obtained from newspaper waste papers, magazine waste papers, woodfree waste papers, and the like can be used. These pulps can be used singly or in combination of two or more thereof.

It is preferred to use a filler in the base paper for the purposes of enhancing the coating adaptability and adjusting the opacity and whiteness after coating. Examples of the filler that can be used include inorganic pigments such as calcium carbonate heavy, precipitated calcium carbonate light, silicates (for example, kaolin, calcined clay, pyrophyllite, sericite, and talc), and titanium dioxide; and organic pigments such as urea resins and styrene based resins. The compounding ratio of such a filler is preferably from 3 to 20% by weight, and more preferably from 5 to 15% by weight based on the total amount of the base paper.

Further, a variety of chemicals to be used in the base paper, such as sizing agents, can be used by means of internal addition or external addition. Examples of sizing agents include rosin based sizing agents, synthetic sizing agents, petroleum resin based sizing agents, and neutral sizing agents. Also, combinations with a fixing agent of a proper sizing agent such as aluminum sulfate and cationic starches and fibers can be used. Neutral sizing agents such as alkenyl succinic anhydride based sizing agents, alkylketene dimers, alkenylketene dimers, neutral rosin, petroleum sizing, and styrene-acrylic resins are preferable from the viewpoint of storage stability of papers after copying in electrophotographic copiers, printers, and the like.

In addition, for the purpose of regulating the surface electric resistance value of base paper, inorganic materials such as sodium chloride, potassium chloride, calcium chloride, sodium sulfate, zinc oxide, titanium dioxide, tin oxide, aluminum oxide, and magnesium oxide; and organic materials such as alkylphosphoric acid esters, alkylsulfuric acid esters, sodium sulfonate salts, and quaternary ammonium salts can be used singly or in admixture. Besides, a variety of auxiliaries usually compounded in base paper for coated paper, such as paper strength additives, dyestuffs, and pH adjustors, can be properly used.

Next, the coated layer will be described below. The coated layer contains a pigment and an adhesive.

Examples of the pigment include pigments generally used in coated paper such as mineral pigments (for example, calcium carbonate heavy, precipitated calcium carbonate light, titanium dioxide, aluminum hydroxide, satin white, talc, calcium sulfate, barium sulfate, zinc oxide, magnesium oxide, magnesium carbonate, amorphous silica, colloidal silica, white carbon, kaolin clay, calcined clay, delaminated clay, aluminosilicates, sericite, bentonite, and smectites) and uniform type or hollow type organic pigments composed mainly of a styrene based resin (for example, polystyrene and polymethylstyrene), an acrylic resin (for example, polymethyl methacrylate, polymethyl acrylate, and polyacrylonitrile), a urea-formaldehyde resin, polyvinyl chloride, polycarbonate, or the like. These pigments can be used singly or in combination of two or more thereof. It is preferable from the viewpoint of revelation of gloss that kaolin clay and/or talc, each of which is in the tabular crystal form, is contained.

The adhesive contains latex having a glass transition temperature of 20° C. or higher. The glass transition temperature is preferably from 30 to 80° C. When the glass transition temperature is lower than 20° C., the strength of the coated layer lowers, whereby the adhesive is liable to generate a paper powder together with a pigment such as kaolin clay. Also, the adhesive in the generated paper powder is liable to become tacky and adhere to the photoreceptor, whereby defects of image quality such as image void are liable to occur. On the other hand, when the glass transition temperature exceeds 80° C., the adhesiveness of the coated layer tends to become inferior at the time of drying the coated paper, and the strength of the coated layer is reduced, whereby a paper powder is likely generated.

The latex may be one having a glass transition temperature of 20° C. or higher, and synthetic latices made of a copolymer (for example, styrene-butadiene based copolymers, styrene-acrylic copolymers, ethylene-vinyl acetate based copolymers, butadiene-methyl methacrylate based copolymers, vinyl acetate-butyl acrylate based copolymers, acrylic acid-methyl methacrylate based copolymers, and vinyl alcohol-maleic anhydride based copolymers) can be used. Of these latices, styrene-butadiene based latices and acrylonitrile-butadiene based latices are preferable.

It is preferable that the latex having a glass transition temperature of 20° C. or higher is contained in an amount of 40% by weight or more based on the whole adhesive contained in the coated layer. When the amount of the latex is less than 40% by weight, influences of the adhesive component are revealed, and therefore, such is not preferred from the viewpoints of generation of a paper powder and adhesion of the paper powder to the photoreceptor. Also, the content of the latex having a glass transition temperature of 20° C. or higher is preferably from 40 to 100% by weight.

Also, it is possible to compound the adhesive with generally known adhesives such as oxidized starch, esterified starch, enzyme-modified starch, and cold water-soluble starches obtained by flash drying these starches, and natural adhesives (for example, casein and soybean protein).

The foregoing respective adhesive is preferably used in an amount of from 5 to 50 parts by weight, and more preferably from 10 to 30 parts by weight based on 100 parts by weight of the pigment. Also, if desired, a variety of auxiliaries compounded in usual pigments for coated paper, such as dispersants, thickeners, water-retention agents, antifoaming agents, and waterproofing agents may be used.

The coated paper is usually produced by coating a pigment having a mean particle size of not more than 1 micron in an amount of 10 g/m$^2$ or more per one surface of base paper using a variety of coaters and then smoothening the resulting surface by calendering.

In the case of producing the coated paper, first of all, the foregoing respective components are compounded to prepare a coating solution composition. Next, the coating solution composition is coated in single layer or multiple layers on a substrate preferably in an amount ranging from 8 to 50 g/m$^2$, and more preferably from 10 to 25 g/m$^2$ on a dry weight basis per one surface of the substrate by means of on-machine or off-machine using a coating device generally used in the general production of coated paper such as a blade coater, an air knife coater, a roll coater, a reverse roll coater, a bar coater, a curtain coater, a die coater, and a gravure coater.

The smoothening treatment after coating is carried out using a usually used smoothening device such as a super calender, a machine calender, and a soft nip calender. And the coated paper is finished such that the glossiness is preferably 10% or more, more preferably 50% or more, and further preferably 60% or more. When the glossiness is 10% or more, a sufficient definition of image quality can be obtained in forming an image.

The coated layer of the thus obtained coated paper is adjusted such that it preferably has a density of not more than 1.20 g/m$^3$, and more preferably not more than 1.10 g/m$^3$.

Also, for the purpose of reducing blister generated in the fixing step, it is preferable that the coated paper is finished so as to have an Oken type air permeability of not longer than 8,000 seconds. Examples of methods for achieving this include selection of a pigment having good alignment after calendering (for example, organic pigments, delaminated clay, and columnar pigments), lamination of the coated layer, and increase of the roll temperature of finishing calender. These methods are properly combined and used depending upon the purpose. In the lamination of the coated layer, coating of a lower layer is made for the purpose of filling the base paper, whereby the surface coated layer as an upper layer enhances the smoothness to make it easy to achieve high white paper gloss.

The thus obtained coated paper preferably has a basis weight in the range of from 70 to 280 g/m$^2$. When the basis weight of the coated paper is less than 70 g/m$^2$, the amount of heat applied to the paper at the time of fixing becomes large, and the water vapor pressure becomes too large, whereby blister is likely generated especially at the time of high humidity. On the other hand, when it exceeds 280 g/m$^2$, the amount of heat against the paper becomes small, whereby the amount of heat required for fixing a toner to the paper is liable to become insufficient.

Further, the moisture content in the paper immediately after unsealing is preferably in the range of from 3.0 to 6.5%. When the moisture content immediately after unsealing is less than 3.0%, the water vapor pressure inside the paper becomes small. However, when the paper is allowed to stand after unsealing, since it has high hygroscopicity and absorbs the moisture to the equilibrium moisture content within a few period of time, the paper tends to cause waving. On the other hand, when the moisture content immediately after unsealing exceeds 6.5%, there are tendencies such that the water vapor pressure becomes large, that the degree of blister becomes large, and that the generation of blocking at the time of coating of the coated layer in the production, dusting at the time of calendering, or curling after copying cannot be prevented.

Also, the coated paper is adjusted by a paper making machine, a dryer of a coater, a calendering step, etc. such that it preferably has a water content immediately after unsealing of from 3.0 to 6.5%, and more preferably from 4.5 to 5.5%. Also, in order that moisture absorption and desorption may not occur at the time of storage, coated papers are wrapped by moisture-proofing wrapping paper such as polyethylene laminated paper or polypropylene.

Such coated papers have been usually used in the field of commercial printing. When they are applied to electrophotographic copiers or printers in place of PPC papers or printer papers, the image definition can be enhanced.

As described previously, when image formation is carried out by applying the foregoing specific photoreceptor and the foregoing specific coated paper to the foregoing electrophotographic device 100, it is possible to sufficiently prevent the generation of a paper powder of coated paper and adhesion of the paper powder to the surface of the electrophotographic photoreceptor and stably obtain images having a high definition of image quality. Also, the image formation can be especially suitably used in the case of obtaining color images.

Figure 5:
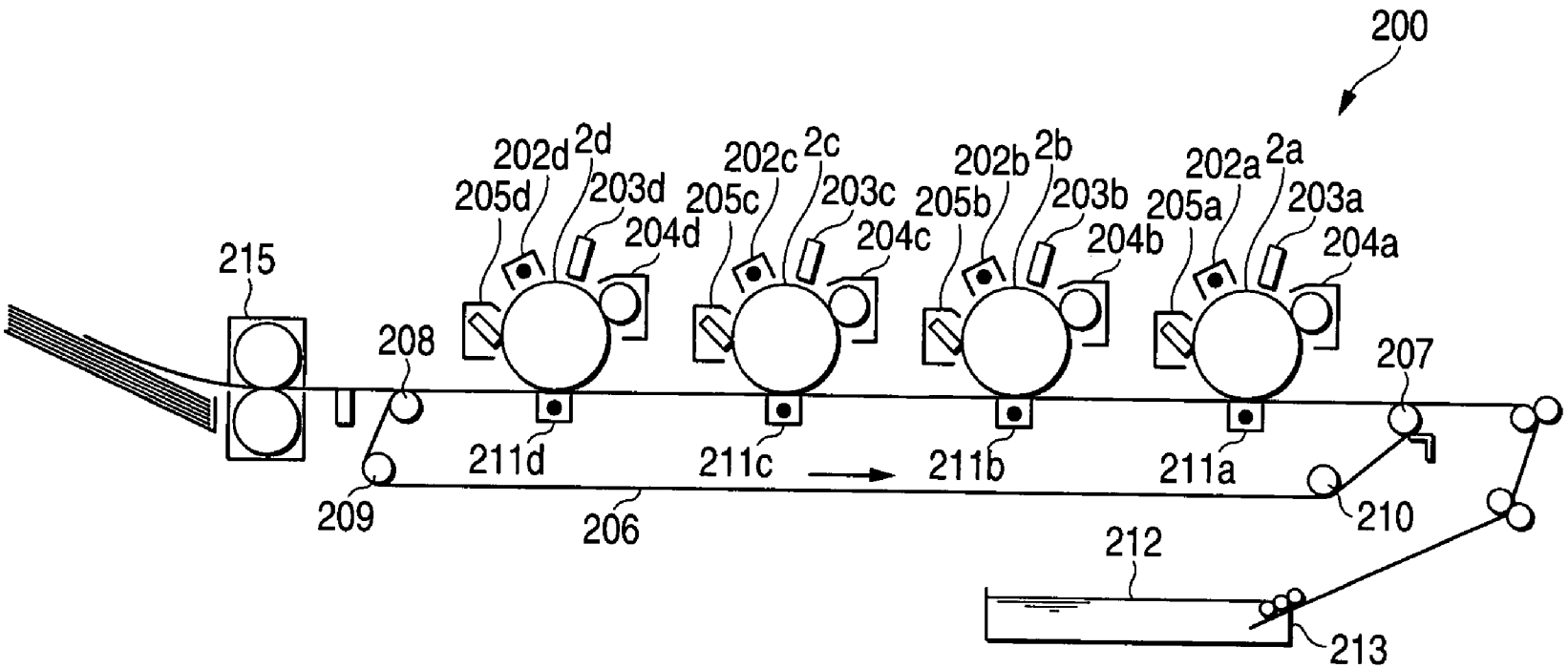
FIG. 5 is a schematic constitutional view showing another suitable embodiment of an image forming device of the invention.

FIG. 5 is a schematic constitutional view showing another embodiment of an electrophotographic device to be suitably used in the method of the invention. In FIG. 5, an electrophotographic device 200 is an electrophotographic device not provided with an intermediate transfer body. Likewise the electrophotographic device shown in FIG. 1, four drum-form electrophotographic photoreceptors 2*a* to 2*d* (for example, the electrophotographic receptor 2*a* can form an image comprising a yellow color; the electrophotographic photoreceptor 2*b* can form an image comprising a magenta color; the electrophotographic photoreceptor 2*c* can form an image comprising a cyan color; and the electrophotographic photoreceptor 2*d* can form an image comprising a black color, respectively) are mutually disposed in parallel along a paper conveying belt 206.

Here, the electrophotographic photoreceptors 2*a* to 2*d* mounted in the electrophotographic device 200 are each constituted of the foregoing electrophotographic photoreceptor 1.

The respective electrophotographic photoreceptors 2*a* to 2*d* can be rotated at a prescribed peripheral speed (process speed) in the prescribed direction (anticlockwise direction on paper) . In the respective electrophotographic photoreceptors 2*a* to 2*d*, charging units 202*a* to 202*d*, exposure units 203*a* to 203*d*, development units 204*a* to 204*d*, transfer units 211*a* to 211*d*, and cleaning units 205*a* to 205*d* are disposed along the rotation direction.

As the exposure units 203*a* to 203*d*, development units 204*a* to 204*d*, transfer units 211*a* to 211*d*, and cleaning units 205*a* to 205*d*, those which are generally used can be employed. Also, in the electrophotographic device 200, a scorotron charger is used as each of the charging units 202*a* to 202*d*. Toners of four colors of yellow (Y), magenta (M), cyan (C) and black (K) each contained in a cartridge (not shown) can be fed into the development units 204*a* to 204*d*. Also, the transfer units 211*a* to 211*d* come into contact with the electrophotographic photoreceptors 2*a* to 2*d*, respectively via the paper conveying belt 206.

Incidentally, the development units 204*a* to 204*d* are disposed in the order of the Y, M, C and K toner colors in FIG. 5. However, this order can be properly set up according to the image forming method of, for example, a system of M, Y, C and K.

Thus, likewise the electrophotographic device 100 in FIG. 1, charging, exposure, development, transfer and cleaning steps are carried out in order in the rotation step of the electrophotographic photoreceptors 2*a* to 2*d*.

The paper conveying belt 206 is supported by a prescribed tension by rolls 207, 208, 209 and 210 and can be rotated at the same peripheral speed as in the electrophotographic photoreceptors 2*a* to 2*d* without causing deflection by means of rotation of these rolls.

Also, a tray 213 is provided at a prescribed position within the electrophotographic device 200, and the foregoing coated papers as a medium 212 to be transferred are provided in the tray 213. The medium 212 to be transferred is successively transported between the electrophotographic photoreceptors 2*a* to 2*d* and the transfer units 211*a* to 211*d* and between fixing units 215 comprising rolls coming into contact with each other and discharged out from the electrophotographic device 200. Thus, toner images formed in the electrophotographic photoreceptors 2*a* to 2*d* are successively transferred onto the medium 212 to be transferred, thereby forming an image (black-and-while or color image), which is then fixed.

In the electrophotographic device 200, color images having a different color from each other are superimposed on and transferred to the medium 212 to be transferred, thereby forming a color toner image. This color toner image is fixed to the medium 212 to be transferred by the fixing units 215 and becomes a color image.

EXAMPLES

The invention will be further specifically described below with reference to the following Examples and Comparative Examples, but it should not be construed that the invention is limited thereto. Incidentally, in the following Examples, the term "parts" means a weight part.

(Photoreceptor 1)

First of all, a specular aluminum pipe of 84 mmϕ×340 mm (JIS H4080, Material Code: A1050) is prepared and subjected to wet honing treatment (according to the method described in JP-A-2-87154). That is, using a liquid honing device, 10 kg of an abrasive (GREENDENSIC GC#400, manufactured by Showa Denko K. K.) is suspended in 40 liters of water; the suspension is fed into a gun at a flow rate of 6 L/min using a pump and blown to the aluminum pipe at a blowing rate of 60 mm/min under an air pressure of 0.85 kgf/cm$^2$, thereby subjecting the aluminum pipe to wet honing treatment while rotating it at 120 rpm and moving to the axis direction. There is thus obtained a conductive support 2. This conductive support 2 has a center line average roughness $R_a$ of 0.17 μm.

170 parts of n-butyl alcohol having 4 parts of a polyvinyl butyral resin (S-LEC BM-S, manufactured by Sekisui Chemical Co., Ltd.) dissolved therein, 30 parts of an organozirocnium compound (acetylacetone zirconium butyrate), and 3 parts of a mixture of an organic silane compound (γ-aminopropyl trimethoxysilane) are mixed to obtain a coating solution for forming a subbing layer. The coating solution for forming a subbing layer is coated on the foregoing conductive support 2, followed by air drying at room temperature for 5 minutes. Thereafter, the resulting conductive support 2 is heated at 50° C. for 7 minutes and subjected to humidification and curing promotion treatment in a thermo-hygrostat at 50° C. and at 85% RH (dew point: 47° C.) for 10 minutes. Next, the resulting conductive support 2 is dried at 135° C. for 10 minutes by a hot-air drying machine. There is thus formed a subbing layer on the conductive support 2.

Next, a mixture consisting of 15 parts of chlorogallium phthalocyanine having strong diffraction peaks at positions of 7.4°, 16.6°, 25.5° and 28.3° in a Bragg angle (2θ±0.2°) of the X-ray diffraction spectrum using CuKα-rays as a charge generation material, 10 parts of a vinyl chloride-vinyl acetate copolymer resin (VMCH, manufactured by Nippon Unicar Company Limited) as a binder resin, and 300 parts of n-butyl alcohol is dispersed for 4 hours in a sand mill. The resulting dispersion is used as a coating solution for forming a charge generation layer and subjected to immersion coating on the subbing layer, followed by drying to form a charge generation layer having a film thickness of 28 μm.

Next, 20 parts of N,N'-bis (3-methylphenyl)-N,N'-diphenylbenzidine, 20 parts of N,N'-bis(3,4-dimethylphenyl)-biphenyl-4-amine, and 60 parts of a bisphenol Z polycarbonate resin (viscosity average molecular weight: 40,000) are thoroughly dissolved in and mixed with 280 parts of tetrahydrofuran and 120 parts of toluene. To the mixed solution, 10 parts of tetrafluoroethylene resin particles are added. After further mixing, the mixture is dispersed in a sand grinder using glass beads, to prepare a dispersion of tetrafluoroethylene resin particles. The resulting dispersion is used as a coating solution for forming a charge transport layer and subjected to immersion coating on the charge generation layer, followed by drying to form a charge transport layer having a film thickness of 28 μm. Incidentally, the content of the fluorine based resin component in the charge transport layer is 9.1% by weight.

(Photoreceptor 2)

Photoreceptor 2 is prepared in the same manner as in the Photoreceptor 1, except that the charge transport layer provided on the surface of the Photoreceptor 1 is formed using a coating solution for forming a charge transport layer prepared by thoroughly dissolving and mixing 20 parts of N,N'-bis(3-methylphenyl)-N,N'-diphenylbenzidine, 20 parts of N,N'-bis(3,4-dimethylphenyl)biphenyl-4-amine, and 60 parts of a bisphenol Z polycarbonate resin (viscosity average molecular weight: 40,000) in 280 parts of tetrahydrofuran and 120 parts of toluene.

That is, the Photoreceptor 2 having the same constitution as the Photoreceptor 1, except that tetrafluoroethylene resin particles are not added to the Photoreceptor 1, is prepared.

(Coated Paper 1)

To a pulp slurry consisting of 80 parts of LBKP (freeness (CSF)=320 mL) and 20 parts of NBKP (freeness (CSF)=440 mL), precipitated calcium carbonate light (TP-121, manufactured by Okutama Kogyo Co., Ltd.) is added such that the addition amount is 10% by weight, to which are then added 2 parts of starch, 1.5 parts of a rosin sizing agent, and 2 parts of aluminum sulfate based on the weight of the pulp. The mixture is subjected to paper making using a fourdrinier paper machine. Next, oxidized starch (Ace A, manufactured by Oji Cornstarch Co., Ltd.) is coated on this wet paper using a size press machine such that the coating amount is 2.0 g/m$^2$ in terms of dry weight, and the resulting paper is subjected to smoothening treatment using a machine calender such that the Oken type smoothness is 40 seconds, to obtain base paper having a basis weight of 75 g/m$^2$.

Next, 100 parts of a blend of 25 parts of precipitated calcium carbonate light (TP-123, manufactured by Okutama Kogyo Co., Ltd.) and 75 parts of kaolin clay (Ultra White 90, manufactured by Engelhard Corporation) as a pigment component is compounded with 3 parts of oxidized starch (Oji Ace B, manufactured by Oji Cornstarch Co., Ltd.) and 12 parts of acrylonitrile-butadiene based latex having a glass transition temperature of 26° C. (Nipol 1577, manufactured by Zeon Corporation) as an adhesive, and 0.3 parts of a dispersant (Aron T-40, manufactured by Toagosei Co., Ltd.) to prepare a coating composition.

The resulting coating composition is coated on the both surfaces of the foregoing base paper using a blade coater such that the coating amount per one surface of the base paper is 15 g/m$^2$ and then subjected to smoothening treatment using a super calender at a roll temperature of 50° C. such that the white paper glossiness (75 degree specular glossiness defined in JIS P8142, hereinafter the same) is 69% and that the moisture content in paper is 4.8%, to obtain Coated Paper 1 having a basis weight of 105 g/m$^2$. Incidentally, for the sake of preventing moisture absorption, the resulting Coated Paper 1 is put and stored in a moisture-proofing bag and provided for quality evaluation. Also, in the following preparation of coated papers, the prepared coated papers are each put and stored in a moisture-proofing bag in the same manner.

(Printing Test 1)

The following Printing Test 1 is carried out using the resulting Photoreceptors 1 and 2 and Coated Paper 1.

First of all, each of the Photoreceptors 1 and 2 is fitted in Color DoucTech 60 manufactured by Fuji Xerox Co., Ltd. (having the same constitution as in the image forming device shown in FIG. 1), and the Coated Paper 1 is used as printing paper, thereby preparing an electrophotographic device. Here, image formation is carried out using the Photoreceptor 1 in Example 1, and image formation is carried out using the Photoreceptor 2 in Comparative Example 1, respectively. Incidentally, a scorotron charger is used as a charger of the electrophotographic device, and a seamless belt having a volume resistance value of $10^{10}$ Ωcm is prepared as an intermediate transfer body by dispersing carbon particles in polyimide to adjust the resistance and centrifugally molding the molding solution.

The Printing Test 1 is carried out at a process speed of 264 mm/sec. Incidentally, prior to the Printing Test 1, the condition of the charger is adjusted such that the potential in dark area ($V_H$) is −650 V, and then, the exposure amount is adjusted such that the potential in exposed area ($V_L$) is −300 V.

Also, in the Printing Test 1, in order that separated materials from the coated paper may adhere to the photoreceptor to likely cause deterioration of image quality, the electrophotographic device is allowed to stand overnight under high-temperature and high-humidity conditions at 30° C. and at 85%, and color image printing of 10,000 sheets per day is carried out under the same conditions. Subsequently, the electrophotographic device is allowed to stand through the night in the same environment, and on the next day, printing of 10,000 sheets is continued. Thus, color image printing of 30,000 sheets in total is carried out.

Then, the photoreceptor is evaluated with respect to charge potential and image at the initial stage of start of the test and after printing of 30,000 sheets. The image is evaluated according to the following criteria.

A: The image is good and free from any problem.

B: Image void is partially observed.

C: Image void is entirely observed.

The results obtained are shown in Table 21.

TABLE 21

| | | | | At initial stage | | After printing of 30,000 sheets | |
|---|---|---|---|---|---|---|---|
| | Photo-receptor | Coated Paper | Glossi-ness | Charge potential | Image | Charge potential | Image |
| Example 1 | 1 | 1 | 69% | −650 V | A | −650 V | A |
| Comparative Example 1 | 2 | 1 | 69% | −650 V | A | −630 V | B |

(Coated Paper 2)

Based paper is obtained in the same manner as in the Coated Paper 1. Next, 80 parts of precipitated calcium carbonate light (TP-123, manufactured by Okutama Kogyo Co., Ltd.) and 20 parts of kaolin clay (Ultra White 90, manufactured by Engelhard Corporation) are blended as a pigment component. 100 parts of the pigment component is compounded with 3 parts of oxidized starch (Oji Ace B, manufactured by Oji Cornstarch Co., Ltd.) and 12 parts of acrylonitrile-butadiene based latex having a glass transition temperature of 26° C. (Nipol 1577, manufactured by Zeon Corporation) as an adhesive, and 0.3 parts of a dispersant (Aron T-40, manufactured by Toagosei Co., Ltd.) to prepare a coating composition.

The resulting coating composition is coated on the both surfaces of the foregoing base paper using a blade coater such that the coating amount per one surface of the base paper is 15 g/m$^2$ and then subjected to smoothening treatment using a soft nip calender at a roll temperature of 150° C. such that the white paper glossiness is 15% and that the moisture content in paper is 4.9%, to obtain Coated Paper 2 having a basis weight of 105 g/m$^2$.

(Coated Paper 3)

To a pulp slurry consisting of 70 parts of LBKP (freeness (CSF)=310 mL) and 30 parts of NBKP (freeness (CSF)=440 mL), precipitated calcium carbonate light (TP-121, manufactured by Okutama Kogyo Co., Ltd.) is added such that the addition amount is 10% by weight, to which are then added 0.2 parts of an alkenyl succinic anhydride as an internal addition sizing agent, 0.5 parts of cationic starch, and 0.8 parts of a polyacrylamide based resin (Harmide EX360, manufactured by Harima Chemicals, Inc.) based on the weight of the pulp. The mixture is subjected to paper making using a fourdrinier paper machine.

Next, oxidized starch (Ace A, manufactured by Oji Cornstarch Co., Ltd.) is coated on this wet paper using a size press machine such that the coating amount is 2.0 g/m$^2$ in terms of dry weight, and the resulting paper is subjected to smoothening treatment using a machine calender such that the Oken type smoothness is 30 seconds, to obtain base paper having a basis weight of 75 g/m$^2$.

Next, 40 parts of precipitated calcium carbonate light (TP-123, manufactured by Okutama Kogyo Co., Ltd.) and 60 parts of kaolin (Ultra White 90, manufactured by Engelhard Corporation) are blended as a pigment component. 100 parts of the pigment component is compounded with 3 parts of oxidized starch (Oji Ace B, manufactured by Oji Cornstarch Co., Ltd.) and 12 parts of acrylonitrile-butadiene based latex having a glass transition temperature of 26° C. (Nipol 1577, manufactured by Zeon Corporation) as an adhesive, and 0.3 parts of a dispersant (Aron T-40, manufactured by Toagosei Co., Ltd.) to prepare a coating composition.

The resulting coating composition is coated on the both surfaces of the foregoing base paper using a blade coater such that the coating amount per one surface of the base paper is 15 g/m$^2$ and then subjected to smoothening treatment using a super calender at a roll temperature of 50° C.

such that the white paper glossiness is 43% and that the moisture content in paper is 5.0%, to obtain Coated Paper 3 having a basis weight of 105 g/m$^2$.

(Coated Paper 4)

To a pulp slurry consisting of 40 parts of LBKP (freeness (CSF)=350 mL) and 60 parts of NBKP (freeness (CSF)=440 mL), precipitated calcium carbonate light (TP-121, manufactured by Okutama Kogyo Co., Ltd.) is added such that the addition amount is 10% by weight, to which are then added 2 parts of starch, 1.5 parts of a rosin sizing agent, and 2 parts of aluminum sulfate based on the weight of the pulp. The mixture is subjected to paper making using a fourdrinier paper machine.

Next, oxidized starch (Ace A, manufactured by Oji Cornstarch Co., Ltd.) is coated on this wet paper using a size press machine such that the coating amount is 2.0 g/m$^2$ in terms of dry weight, and the resulting paper is subjected to smoothening treatment using a machine calender such that the Oken type smoothness is 30 seconds, to obtain base paper having a basis weight of 75 g/m$^2$.

Next, 30 parts of precipitated calcium carbonate light (TP-123, manufactured by Okutama Kogyo Co., Ltd.) and 70 parts of kaolin (Ultra White 90, manufactured by Engelhard Corporation) are blended as a pigment component. 100 parts of the pigment component is compounded with 3 parts of oxidized starch (Oji Ace B, manufactured by Oji Cornstarch Co., Ltd.) and 14 parts of styrene-butadiene based latex having a glass transition temperature of 40° C. (0602, manufactured by JSR Corporation) as an adhesive, and 0.3 parts of a dispersant (Aron T-40, manufactured by Toagosei Co., Ltd.) to prepare a coating composition. The resulting coating composition is coated on the both surfaces of the foregoing base paper using a blade coater such that the coating amount per one surface of the base paper is 15 g/m$^2$ and then subjected to smoothening treatment using a super calender at a roll temperature of 60° C. such that the white paper glossiness is 60% and that the moisture content in paper is 4.7%, to obtain Coated Paper 4 having a basis weight of 105 g/m$^2$.

(Coated Paper 5)

To a pulp slurry consisting of 60 parts of LBKP (freeness (CSF)=310 mL) and 40 parts of NBKP (freeness (CSF)=440 mL), precipitated calcium carbonate light (TP-121, manufactured by Okutama Kogyo Co., Ltd.) is added such that the addition amount is 10% by weight, to which are then added 2 parts of starch, 1.5 parts of a rosin sizing agent, and 2 parts of aluminum sulfate based on the weight of the pulp. The mixture is subjected to paper making using a fourdrinier paper machine.

Next, oxidized starch (Ace A, manufactured by Oji Cornstarch Co., Ltd.) is coated on this wet paper using a size press machine such that the coating amount is 2.0 g/m$^2$ in terms of dry weight, and the resulting paper is subjected to smoothening treatment using a machine calender such that the Oken type smoothness is 40 seconds, to obtain base paper having a basis weight of 75 g/m$^2$.

Next, 80 parts of precipitated calcium carbonate light (TP-222H, manufactured by Okutama Kogyo Co., Ltd.) and 20 parts of talc come from Korea are blended as a pigment component. 100 parts of the pigment component is compounded with 8 parts of oxidized starch (Oji Ace B, manufactured by Oji Cornstarch Co., Ltd.) and 12 parts of acrylonitrile-butadiene based latex having a glass transition temperature of 26° C. (Nipol 1577, manufactured by Zeon Corporation) as an adhesive, and 0.5 parts of a dispersant (Aron T-40, manufactured by Toagosei Co., Ltd.) to prepare a coating composition. The resulting coating composition is coated on the both surfaces of the foregoing base paper using a blade coater such that the coating amount per one surface of the base paper is 5 g/m$^2$.

Further, 20 parts of precipitated calcium carbonate light (TP-222H, manufactured by Okutama Kogyo Co., Ltd.) and 80 parts of kaolin (Ultra White 90, manufactured by Engelhard Corporation) are blended as a pigment component. 100 parts of the pigment component is compounded with 6 parts of oxidized starch (Oji Ace B, manufactured by Oji Cornstarch Co., Ltd.) and 10 parts of acrylonitrile-butadiene based latex having a glass transition temperature of 26° C. (Nipol 1577, manufactured by Zeon Corporation) as an adhesive, and 0.3 parts of a dispersant (Aron T-40, manufactured by Toagosei Co., Ltd.) to prepare a coating composition. The resulting coating composition is coated on the both surfaces of the foregoing base paper the both surfaces of which had been coated using a blade coater such that the coating amount per one surface of the base paper is 10 g/m$^2$ and then subjected to smoothening treatment using a super calender such that the white paper glossiness is 63% and that the moisture content in paper is 5.0%, to obtain electrophotographic paper of Coated Paper 5 having a basis weight of 105 g/m$^2$.

(Coated Paper 6)

Coated Paper 6 having a basis weight of 128 g/m$^2$ is obtained in the same manner as in the Coated Paper 1, except for changing the base paper to base paper having a basis weight of 98 g/m$^2$.

(Coated Paper 7)

Coated Paper 7 having a basis weight of 157 g/m$^2$ is obtained in the same manner as in the Coated Paper 1, except for changing the base paper to base paper having a basis weight of 127 g/m$^2$.

(Printing Test 2)

Printing Test 2 is carried out in the same manner as in the Printing Test 1 using the same photoreceptors as the Photoreceptors 1 and 2 (referred to as Photoreceptors 1 and 2 likewise the Printing Test 1) and the Coated Papers 2 to 7.

First of all, each of the Photoreceptors 1 and 2 is fitted in Color DoucTech 60 manufactured by Fuji Xerox Co., Ltd., and each of the Coated Papers 2 to 7 is used as printing paper, thereby preparing an electrophotographic device.

Here, image formation is carried out using the Photoreceptor 1 in Example 2, and image formation is carried out using the Photoreceptor 2 in Comparative Example 2, respectively. Incidentally, the Coated Paper 2 is used as printing paper in both of Example 2 and Comparative Example 2. Also, image formation is carried out using each of the photoreceptors and each of the coated papers shown in Table 22 in Examples 3 to 7 and Comparative Examples 3 to 7, respectively. The results obtained are shown in Table 22. Also, the glossiness of each of the coated papers is shown in Table 22.

TABLE 22

| | | | | At initial stage | | After printing of 30,000 sheets | |
|---|---|---|---|---|---|---|---|
| | Photo-receptor | Coated Paper | Glossi-ness | Charge potential | Image | Charge potential | Image |
| Example 2 | 1 | 2 | 15% | −650 V | A | −650 V | A |
| Comparative Example 2 | 2 | 2 | 15% | −650 V | A | −635 V | B |
| Example 3 | 1 | 3 | 43% | −650 V | A | −650 V | A |
| Comparative Example 3 | 2 | 3 | 43% | −650 V | A | −630 V | B |
| Example 4 | 1 | 4 | 60% | −650 V | A | −650 V | A |
| Comparative Example 4 | 2 | 4 | 60% | −650 V | A | −635 V | B |
| Example 5 | 1 | 5 | 63% | −650 V | A | −650 V | A |
| Comparative Example 5 | 2 | 5 | 63% | −650 V | A | −635 V | B |
| Example 6 | 1 | 6 | 69% | −650 V | A | −650 V | A |
| Comparative Example 6 | 2 | 6 | 69% | −650 V | A | −630 V | B |
| Example 7 | 1 | 7 | 69% | −650 V | A | −650 V | A |
| Comparative Example 7 | 2 | 7 | 69% | −650 V | A | −630 V | B |

(Printing Test 3)

Printing Test 3 is carried out in the same manner as in the Printing Test 1 using the same photoreceptor as the Photoreceptor 1 and the same coated paper as the Coated Paper 1 (referred to as Coated Paper 1 likewise the Printing Test 1), except that the content of the fluorine based resin fine particles in the charge transport layer is different. Incidentally, a photoreceptor having a constitution described later is used in Example 11.

The photoreceptor is fitted in Color DoucTech 60 manufactured by Fuji Xerox Co., Ltd., and the Coated Paper 1 is used as printing paper, thereby preparing an electrophotographic device. Here, the photoreceptor having a varied content of the tetrafluoroethylene resin particles of the Photoreceptor 1 shown in Table 23 is used. The results obtained are shown in Table 23. Incidentally, the potential after exposure of the photoreceptor (potential after exposure) is also measured and evaluated. Also, the data of Example 1 are shown for reference.

Here, the photoreceptor of Example 11 is prepared in the following manner. First of all, a subbing layer and a charge generation layer are formed on a conductive support in the same manner as in the Photoreceptor 1. Next, 34 parts of N,N'-bis(3-methylphenyl)-N,N'-diphenylbenzidine and 51 parts of a bisphenol Z polycarbonate resin (viscosity average molecular weight: 40,000) are thoroughly dissolved in and mixed with 280 parts of tetrahydrofuran and 120 parts of toluene. To the mixed solution, 8.6 parts of rinsed tetrafluoroethylene resin particles (L-2, manufactured Daikin Industries, Ltd.), 0.2 parts of silicon oxide fine particles (hydrophobic silica Aerosil R104), and 0.2 parts of a fluorine based graft polymer (GF300, manufactured by Toagosei Co., Ltd.) are added and mixed. Thereafter, the mixture is dispersed in a sand grinder using glass beads to prepare a tetrafluoroethylene resin particle dispersion. Using the resulting dispersion as a coating solution for forming a charge transport layer, a photoreceptor to be used in Example 11 is prepared in the same manner as in the Photoreceptor 1. Incidentally, by adding a fluorine based graft polymer at the time of dispersion, a charge transport layer having excellent dispersibility is obtained.

As is clear from the results shown in Table 23, it is confirmed that good images are obtained even by changing the content of the fluorine based resin fine particles. Also, by changing the addition amount of the fluorine based resin fine particles, a difference in the potential after exposure is caused due to the repeated use.

TABLE 23

| | Photoreceptor | | At initial stage | | | After printing of 30,000 sheets | | |
|---|---|---|---|---|---|---|---|---|
| | (Content of fluorine based fine particles) | Coated Paper | Charge potential | Potential after exposure | Image | Charge potential | Potential after exposure | Image |
| Example 1 | 9.1% by weight | 1 | −650 V | −300 V | A | −650 V | −317 V | A |
| Example 8 | 3% by weight | 1 | −650 V | −300 V | A | −650 V | −300 V | A |
| Example 9 | 20% by weight | 1 | −650 V | −300 V | A | −650 V | −330 V | A |
| Example 10 | 30% by weight | 1 | −650 V | −300 V | A | −650 V | −340 V | A |
| Example 11 | 8.6% by weight | 1 | −650 V | −300 V | A | −650 V | −321 V | A |

(Photoreceptor 101)

Photoreceptor 101 is prepared in the same manner as in the Photoreceptor 1, except for forming the charge transport layer of the Photoreceptor 1 in the following manner. That is, 20 parts of N,N'-bis(3-methylphenyl)-N,N'-diphenylbenzidine, 20 parts of N,N'-bis(3,4-dimethylphenyl)-biphenyl-4-amine, and 60 parts of a carbonate resin having repeating units comprising a combination shown in Table 24 and a copolymerization ratio shown in Table 24 (viscosity average molecular weight: 40,000) are thoroughly dissolved in and mixed with 280 parts of tetrahydrofuran and 120 parts of toluene. The resulting solution is used as a coating solution for forming a charge transport layer and subjected to immersion coating on the charge generation layer, followed by drying to form a charge transport layer having a film thickness of 28 μm.

TABLE 24

| Repeating unit | Copolymerization ratio |
|---|---|
| II-1 | 0.65 |
| III-2 | 0.25 |
| IV-1 | 0.10 |

(Photoreceptor 102)

Photoreceptor 102 is prepared in the same manner as in the Photoreceptor 101, except for forming the charge transport layer of the Photoreceptor 1 using a coating solution for forming a charge transport layer prepared by thoroughly dissolving and mixing 20 parts of N,N'-bis(3-methylphenyl)-N,N'-diphenylbenzidine, 20 parts of N,N'-bis (3,4-dimethylphenyl)biphenyl-4-amine, and 60 parts of a bisphenol Z polycarbonate resin (viscosity average molecular weight: 40,000) in 280 parts of tetrahydrofuran and 120 parts of toluene.

(Printing Test 101)

The following Printing Test 101 is carried out using the resulting Photoreceptors 101 and 102 and Coated Paper 1.

First of all, each of the Photoreceptors 101 and 102 is fitted in Color DoucTech 60 manufactured by Fuji Xerox Co., Ltd., and the Coated Paper 1 is used as printing paper, thereby preparing an electrophotographic device. Here, image formation is carried out using the Photoreceptor 101 in Example 101, and image formation is carried out using the Photoreceptor 102 in Comparative Example 101, respectively. Incidentally, a scorotron charger is used as a charger of the electrophotographic device, and a seamless belt having a volume resistance value of $10^{10}$ Ωcm is prepared as an intermediate transfer body by dispersing carbon particles in polyimide to adjust the resistance and centrifugally molding the molding solution.

The Printing Test 101 is carried out at a process speed of 264 mm/sec. Incidentally, prior to the Printing Test 101, the condition of the charger is adjusted such that the potential in dark area ($V_H$) is −650 V, and then, the exposure amount is adjusted such that the potential in exposed area ($V_L$) is −300 V.

Also, in the Printing Test 101, in order that separated materials from the coated paper may adhere to the photoreceptor to likely cause deterioration of image quality, the electrophotographic device is allowed to stand overnight under high-temperature and high-humidity conditions at 30° C. and at 85%, and color image printing of 10,000 sheets per day is carried out under the same conditions. Subsequently, the electrophotographic device is allowed to stand through the night in the same environment, and on the next day, printing of 10,000 sheets is continued. Thus, color image printing of 30,000 sheets in total is carried out.

Then, the photoreceptor is evaluated with respect to charge potential and image at the initial stage of start of the test and after printing of 30,000 sheets. The image is evaluated according to the following criteria.

A: The image is good and free from any problem.

B: Image void is partially observed.

C: Image void is entirely observed.

The results obtained are shown in Table 25.

TABLE 25

| | | | | At initial stage | | After printing of 30,000 sheets | |
|---|---|---|---|---|---|---|---|
| | Photo-receptor | Coated Paper | Glossi-ness | Charge potential | Image | Charge potential | Image |
| Example 101 | 101 | 1 | 69% | −650 V | A | −650 V | A |
| Comparative Example 101 | 102 | 1 | 69% | −650 V | A | −630 V | B |

(Printing Test 102)

Printing Test 102 is carried out in the same manner as in the Printing Test 101, except for using the same photoreceptors as the Photoreceptors 101 and 102 (referred to as Photoreceptors 101 and 102 likewise the Printing Test 101) and the Coated Papers 2 to 7.

First of all, each of the Photoreceptors 101 and 102 is fitted in Color DoucTech 60 manufactured by Fuji Xerox Co., Ltd., and each of the Coated Papers 2 to 7 is used as printing paper, thereby preparing an electrophotographic device. Here, image formation is carried out using the Photoreceptor 101 in Example 102, and image formation is carried out using the Photoreceptor 102 in Comparative Example 102, respectively. Incidentally, the Coated Paper 2 is used as printing paper in both of Example 102 and Comparative Example 102. Also, image formation is carried out using each of the photoreceptors and each of the coated papers shown in Table 26 in Examples 103 to 107 and Comparative Examples 103 to 107, respectively. The results obtained are shown in Table 26. Also, the glossiness of each of the coated papers is shown in Table 26.

TABLE 26

| | Photo-receptor | Coated Paper | Glossi-ness | At initial stage Charge potential | At initial stage Image | After printing of 30,000 sheets Charge potential | After printing of 30,000 sheets Image |
|---|---|---|---|---|---|---|---|
| Example 102 | 101 | 2 | 15% | −650 V | A | −650 V | A |
| Comparative Example 102 | 102 | 2 | 15% | −650 V | A | −635 V | B |
| Example 103 | 101 | 3 | 43% | −650 V | A | −650 V | A |
| Comparative Example 103 | 102 | 3 | 43% | −650 V | A | −630 V | B |
| Example 104 | 101 | 4 | 60% | −650 V | A | −650 V | A |
| Comparative Example 104 | 102 | 4 | 60% | −650 V | A | −635 V | B |
| Example 105 | 101 | 5 | 63% | −650 V | A | −650 V | A |
| Comparative Example 105 | 102 | 5 | 63% | −650 V | A | −635 V | B |
| Example 106 | 101 | 6 | 69% | −650 V | A | −650 V | A |
| Comparative Example 106 | 102 | 6 | 69% | −650 V | A | −630 V | B |
| Example 107 | 101 | 7 | 69% | −650 V | A | −650 V | A |
| Comparative Example 107 | 102 | 7 | 69% | −650 V | A | −630 V | B |

(Photoreceptors 103 to 110)

Photoreceptors 103 to 110 are prepared in the same manner as in the Photoreceptor 101, except for forming the charge transport layer of the Photoreceptor 1 using a coating solution for forming a charge transport layer prepared by thoroughly dissolving and mixing 20 parts of N,N'-bis-(3-methylphenyl)-N,N'-diphenylbenzidine, 20 parts of N,N'-bis (3,4-dimethylphenyl)biphenyl-4-amine, and 60 parts of a carbonate resin having repeating units comprising a combination shown in Table 27 and a copolymerization ratio shown in Table 27 (viscosity average molecular weight: 40,000) in 280 parts of tetrahydrofuran and 120 parts of toluene. Incidentally, the Photoreceptors 109 and 110 are each made of a homopolymer.

TABLE 27

| | Repeating unit | Copolymerization ratio |
|---|---|---|
| Photoreceptor 103 | II-4 | 0.70 |
| | III-1 | 0.20 |
| | IV-1 | 0.10 |
| Photoreceptor 104 | I-1 | 0.45 |
| | II-4 | 0.45 |
| | IV-1 | 0.10 |
| Photoreceptor 105 | I-2 | 0.60 |
| | II-4 | 0.30 |
| | IV-3 | 0.10 |
| Photoreceptor 106 | I-1 | 0.60 |
| | I-2 | 0.30 |
| | IV-4 | 0.10 |
| Photoreceptor 107 | I-5 | 0.85 |
| | II-4 | 0.15 |
| Photoreceptor 108 | I-9 | 0.10 |
| | II-4 | 0.90 |
| Photoreceptor 109 | I-1 | 1.00 |
| Photoreceptor 110 | I-2 | 1.00 |

(Photoreceptor 111)

Photoreceptor 111 is prepared in the same manner as in the Photoreceptor 101, except for forming the charge transport layer of the Photoreceptor 1 using a coating solution for forming a charge transport layer prepared by thoroughly dissolving and mixing 20 parts of N,N'-bis(3-methylphenyl)-N,N'-diphenylbenzidine, 20 parts of N,N'-bis (3,4-dimethylphenyl)biphenyl-4-amine, 30 parts of a carbonate resin having a repeating unit represented by the foregoing formula (I-2) (viscosity average molecular weight: 40,000), and 30 parts of a carbonate resin having a repeating unit represented by the foregoing formula (II-4) and a repeating unit represented by the foregoing formula (IV-1) in a copolymerization ratio of 0.9/0.1 (viscosity average molecular weight: 40,000) in 280 parts of tetrahydrofuran and 120 parts of toluene.

(Photoreceptor 112)

Photoreceptor 112 is prepared in the same manner as in the Photoreceptor 101, except for forming the charge transport layer of the Photoreceptor 1 in the following manner. That is, 34 parts of N,N'-bis(3-methylphenyl)-N,N'-diphenylbenzidine and 51 parts of the same carbonate resin used in the preparation of the Photoreceptor 101 (viscosity average molecular weight: 40,000) are thoroughly dissolved in and mixed with 280 parts of tetrahydrofuran and 120 parts of toluene. Further, 8.6 parts of rinsed tetrafluoroethylene resin particles (L-2, manufactured by Daikin Industries, Ltd.), 0.2 parts of silicon oxide fine particles (hydrophobic silica Aerosil R104), and 0.2 parts of a fluorine based graft polymer (GF300, manufactured by Toagosei Co., Ltd.) are added thereto, and the mixture is dispersed in a sand grinder using glass beads. The resulting dispersion is used as a coating solution for forming a charge transport layer.

(Printing Test 103)

Printing Test 103 is carried out in the same manner as in the Printing Test 101 using the Photoreceptors 103 to 112 and the same coated paper as the Coated Paper 1 (referred to as Coated Paper 1 likewise the Printing Test 101). The results obtained are shown in Table 28.

TABLE 28

| | Photo-receptor | Coated Paper | At initial stage: Charge potential | At initial stage: Potential after exposure | At initial stage: Image | After printing of 30,000 sheets: Charge potential | After printing of 30,000 sheets: Potential after exposure | After printing of 30,000 sheets: Image |
|---|---|---|---|---|---|---|---|---|
| Example 108 | 103 | 1 | −650 V | −300 V | A | −650 V | −300 V | A |
| Example 109 | 104 | 1 | −650 V | −300 V | A | −650 V | −306 V | A |
| Example 110 | 105 | 1 | −650 V | −300 V | A | −650 V | −310 V | A |
| Example 111 | 106 | 1 | −650 V | −300 V | A | −630 V | −320 V | A |
| Example 112 | 107 | 1 | −650 V | −300 V | A | −610 V | −290 V | A |
| Example 113 | 108 | 1 | −650 V | −300 V | A | −650 V | −315 V | A |
| Example 114 | 111 | 1 | −650 V | −300 V | A | −650 V | −315 V | A |
| Example 115 | 112 | 1 | −650 V | −300 V | A | −650 V | −319 V | A |
| Comparative Example 108 | 109 | 1 | −650 V | −300 V | B | −610 V | −260 V | B |
| Comparative Example 109 | 110 | 1 | −650 V | −300 V | B | −650 V | −315 V | B |

(Photoreceptor 201)

Photoreceptor 201 is prepared in the same manner as in the Photoreceptor 1, except for forming the charge transport layer of the Photoreceptor 1 in the following manner. That is, 20 parts of N,N'-bis(3-methylphenyl)-N,N'-diphenylbenzidine, 20 parts of N,N'-bis(3,4-dimethylphenyl)-biphenyl-4-amine, and 60 parts of an arylate resin having a repeating unit represented by the foregoing formula (V-2) (viscosity average molecular weight: 40,000) are thoroughly dissolved in and mixed with 280 parts of tetrahydrofuran and 120 parts of toluene to prepare a coating solution for forming a charge transport layer. Incidentally, the foregoing arylate resin is a copolymer having a repeating unit represented by the formula (V-2) in which carbon of the carbonyl group in the right end is bound at the p-position of the benzene ring and a repeating unit represented by the formula (V-2) in which carbon of the carbonyl group in the right end is bound at the m-position of the benzene ring in a ratio of 1/1. The resulting coating solution is subjected to immersion coating on the charge generation layer, followed by drying to form a charge transport layer having a film thickness of 28 μm.

(Photoreceptor 202)

Formation of a charge generation layer is carried out in the same manner as in the Photoreceptor 1. Next, 20 parts of N,N'-bis(3-methylphenyl)-N,N'-diphenylbenzidine, 20 parts of N,N'-bis(3,4-dimethylphenyl)biphenyl-4-amine, and 60 parts of a bisphenol Z polycarbonate resin (viscosity average molecular weight: 40,000) are thoroughly dissolved in and mixed with 280 parts of tetrahydrofuran and 120 parts of toluene to prepare a coating solution for forming a charge transport layer. Using the coating solution, a charge transport layer is formed in the same manner as in the Photoreceptor 201, to prepare Photoreceptor 202.

(Printing Test 201)

The following Printing Test 201 is carried out using the resulting Photoreceptors 201 and 202 and Coated Paper 1.

First of all, each of the Photoreceptors 201 and 202 is fitted in Color DoucTech 60 manufactured by Fuji Xerox Co., Ltd. (having the same constitution as in the image forming device shown in FIG. 1), and the Coated Paper 1 is used as printing paper, thereby preparing an electrophotographic device. Here, image formation is carried out using the Photoreceptor 201 in Example 201, and image formation is carried out using the Photoreceptor 202 in Comparative Example 201, respectively. Incidentally, a scorotron charger is used as a charger of the electrophotographic device. Also, a seamless belt having a volume resistance value of $10^{10}$ Ωcm is prepared as an intermediate transfer body. The seamless belt is prepared by dispersing carbon particles in polyimide to adjust the resistance and centrifugally molding the molding solution.

The Printing Test 201 is carried out at a process speed of 264 mm/sec. Incidentally, prior to the Printing Test 201, the condition of the charger is adjusted such that the potential in dark area ($V_H$) is −650 V, and then, the exposure amount is adjusted such that the potential in exposed area ($V_L$) is −300 V.

Also, in the Printing Test 201, in order that separated materials from the coated paper may adhere to the photoreceptor to likely cause deterioration of image quality, the electrophotographic device is allowed to stand overnight under high-temperature and high-humidity conditions at 30° C. and at 85%, and color image printing of 10,000 sheets per day is carried out under the same conditions. Subsequently, the electrophotographic device is allowed to stand through the night in the same environment, and on the next day, printing of 10,000 sheets is continued. Thus, color image printing of 30,000 sheets in total is carried out.

Then, the photoreceptor is evaluated with respect to charge potential and image at the initial stage of start of the test and after printing of 30,000 sheets. The image is evaluated according to the following criteria.

A: The image is good and free from any problem.

B: Image void is partially observed.

C: Image void is entirely observed.

The results obtained are shown in Table 29.

TABLE 29

| | Photo-receptor | Coated Paper | Glossi-ness | At initial stage: Charge potential | At initial stage: Image | After printing of 30,000 sheets: Charge potential | After printing of 30,000 sheets: Image |
|---|---|---|---|---|---|---|---|
| Example 201 | 201 | 1 | 69% | −650 V | A | −650 V | A |
| Comparative Example 201 | 202 | 1 | 69% | −650 V | A | −625 V | B |

(Coated Paper 16)

Coated Paper 16 having a basis weight of 128 g/m$^2$ is obtained in the same manner as in Coated Paper 1, except for changing the base paper having a basis weight of 75 g/m$^2$ to base paper having a basis weight of 98 g/m$^2$.

(Coated Paper 17)

Coated Paper 17 having a basis weight of 157 g/m$^2$ is obtained in the same manner as in Coated Paper 1, except for changing the base paper having a basis weight of 75 g/m$^2$ to base paper having a basis weight of 127 g/m$^2$.

(Printing Test 202)

Printing Test 202 is carried out in the same manner as in the Printing Test 201 using the same photoreceptors as the Photoreceptors 201 and 202 (referred to as Photoreceptors 201 and 202 likewise the Printing Test 201) and the Coated Papers 2 to 5 and 16 to 17.

First of all, each of the Photoreceptors 201 and 202 is fitted in Color DoucTech 60 manufactured by Fuji Xerox Co., Ltd., and each of the Coated Papers 2 to 5 and 16 to 17 is used as printing paper, thereby preparing an image forming device. Here, image formation is carried out using the Photoreceptor 201 in Example 202, and image formation is carried out using the Photoreceptor 202 in Comparative Example 202, respectively. Incidentally, the Coated Paper 2 is used as printing paper in both of Example 202 and Comparative Example 202. Also, image formation is carried out using each of the photoreceptors and each of the coated papers shown in Table 30 in Examples 203 to 207 and Comparative Examples 203 to 207, respectively. The results obtained are shown in Table 30. Also, the glossiness of each of the coated papers is shown in Table 30.

TABLE 30

| | | | | At initial stage | | After printing of 30,000 sheets | |
|---|---|---|---|---|---|---|---|
| | Photo-receptor | Coated Paper | Glossi-ness | Charge potential | Image | Charge potential | Image |
| Example 202 | 201 | 2 | 15% | −650 V | A | −650 V | A |
| Comparative Example 202 | 202 | 2 | 15% | −650 V | A | −630 V | B |
| Example 203 | 201 | 3 | 43% | −650 V | A | −650 V | A |
| Comparative Example 203 | 202 | 3 | 43% | −650 V | A | −625 V | B |
| Example 204 | 201 | 4 | 60% | −650 V | A | −650 V | A |
| Comparative Example 204 | 202 | 4 | 60% | −650 V | A | −630 V | B |
| Example 205 | 201 | 5 | 63% | −650 V | A | −650 V | A |
| Comparative Example 205 | 202 | 5 | 63% | −650 V | A | −630 V | B |
| Example 206 | 201 | 16 | 69% | −650 V | A | −650 V | A |
| Comparative Example 206 | 202 | 16 | 69% | −650 V | A | −630 V | B |
| Example 207 | 201 | 17 | 69% | −650 V | A | −650 V | A |
| Comparative Example 207 | 202 | 17 | 69% | −650 V | A | −635 V | B |

(Photoreceptors 203 to 211)

In the preparation of Photoreceptors 203 to 210, first of all, a charge generation layer is formed in the same manner as in the Photoreceptor 1. Next, Photoreceptors 203 to 210 are prepared in the same manner as in Photoreceptor 201 using a coating solution for forming a charge transport layer described below. That is, 20 parts of N,N'-bis(3-methylphenyl)-N,N'-diphenylbenzidine, 20 parts of N,N'-bis(3,4-dimethylphenyl)biphenyl-4-amine, and 60 parts of an arylate resin having repeating units comprising a combination shown in Table 31 and a copolymerization ratio shown in Table 31 (viscosity average molecular weight: 40,000) are thoroughly dissolved in mixed with 280 parts of tetrahydrofuran and 120 parts of toluene. Further, 2.5 parts of tetrafluoroethylene resin particles are mixed, and the mixture is dispersed in a sand grinder using glass beads to prepare a coating solution for forming a charge transport layer.

Incidentally, in the foregoing arylate resin, the respective repeating units (for example, (V-1), (VII-1) and (VIII-1) in the Photoreceptor 203) are one having a repeating unit in which carbon of the carbonyl group in the right end is bound at the p-position of the benzene ring and a repeating unit in which carbon of the carbonyl group in the right end is bound at the m-position of the benzene ring in a ratio of 1/1. Also, the acrylate resins in the Photoreceptors 209 and 210 are each a copolymer having a repeating unit represented by the formula (V-10) or (V-19) in which carbon of the carbonyl group in the right end is bound at the p-position of the benzene ring and a repeating unit represented by the formula (V-10) or (V-19) in which carbon of the carbonyl group in the right end is bound at the m-position of the benzene ring in a ratio of 1/1.

TABLE 31

| | Repeating unit | Copolymerization ratio |
|---|---|---|
| Photoreceptor 203 | V-1 | 0.70 |
| | VII-1 | 0.20 |
| | VIII-1 | 0.10 |
| Photoreceptor 204 | V-1 | 0.45 |
| | VI-2 | 0.45 |
| | VIII-1 | 0.10 |
| Photoreceptor 205 | V-2 | 0.50 |
| | VI-4 | 0.50 |
| Photoreceptor 206 | V-1 | 0.60 |
| | V-2 | 0.30 |
| | VIII-2 | 0.10 |

TABLE 31-continued

| | Repeating unit | Copolymerization ratio |
|---|---|---|
| Photoreceptor 207 | V-5 | 0.15 |
| | VI-4 | 0.85 |
| Photoreceptor 208 | V-9 | 0.10 |
| | V-2 | 0.90 |
| Photoreceptor 209 | V-10 | 1.00 |
| Photoreceptor 210 | V-19 | 1.00 |

(Photoreceptor 211)

In the preparation of Photoreceptor 211, first of all, formation of a charge generation layer is carried out in the same manner as in the Photoreceptor 203. Next, a coating solution for forming a charge transport layer is prepared in the same manner as in the Photoreceptor 203, except for using a mixture of a carbonate resin having a repeating unit represented by the following formula (IX) and an arylate resin having a repeating unit represented by the foregoing formula (V-2) and a repeating unit represented by the foregoing formula (VII-1) in a copolymerization ratio of 0.9/0.1 (viscosity average molecular weight: 40,000) in place of the arylate resin in the coating solution for forming a charge transport layer of the Photoreceptor 203. Next, using the resulting coating solution, a charge transport layer is formed in the same manner as in the Photoreceptor 203, thereby preparing Photoreceptor 211. A mix ratio of the carbonate resin and the arylate resin is 2/8. Also, the repeating unit represented by the foregoing formula (V-2) and the repeating unit represented by the foregoing formula (VII-1) are one having a repeating unit in which carbon of the carbonyl group in the right end is bound at the p-position of the benzene ring and a repeating unit in which carbon of the carbonyl group in the right end is bound at the m-position of the benzene ring in a ratio of 1/1.

(IX)

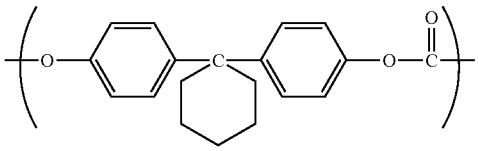

(Photoreceptor 212)

In the preparation of Photoreceptor 212, first of all, a charge generation layer is formed in the same manner as in the Photoreceptor 1. Next, Photoreceptor 212 is prepared in the same manner as in Photoreceptor 201 using a coating solution for forming a charge transport layer described below. That is, 34 parts of N,N'-bis(3-methylphenyl)-N,N'-diphenylbenzidine and 51 parts of the same arylate resin used in preparing the Photoreceptor 201 (viscosity average molecular weight: 40,000) are thoroughly dissolved in mixed with 280 parts of tetrahydrofuran and 120 parts of toluene. Further, 8.6 parts of rinsed tetrafluoroethylene resin particles (L-2, manufactured Daikin Industries, Ltd.), 0.2 parts of silicon oxide fine particles (hydrophobic silica Aerosil R104), and 0.2 parts of a fluorine based graft polymer (GF300, manufactured by Toagosei Co., Ltd.) are added and mixed, and the mixture is dispersed in a sand grinder using glass beads to prepare a coating solution for forming a charge transport layer.

(Printing Test 203)

Printing Test 203 is carried out in the same manner as in the Printing Test 201 using the Photoreceptors 203 to 212 and the same coated paper as the Coated Paper 1 (referred to as Coated Paper 1 likewise the Printing Test 201). The results obtained are shown in Table 32.

TABLE 32

| | | | At initial stage | | | After printing of 30,000 sheets | | |
|---|---|---|---|---|---|---|---|---|
| | Photo-receptor | Coated Paper | Charge potential | Potential after exposure | Image | Charge potential | Potential after exposure | Image |
| Example 208 | 203 | 1 | −650 V | −300 V | A | −650 V | −300 V | A |
| Example 209 | 204 | 1 | −650 V | −300 V | A | −650 V | −305 V | A |
| Example 210 | 205 | 1 | −650 V | −300 V | A | −650 V | −315 V | A |
| Example 211 | 206 | 1 | −650 V | −300 V | A | −630 V | −320 V | A |
| Example 212 | 207 | 1 | −650 V | −300 V | A | −610 V | −280 V | A |
| Example 213 | 208 | 1 | −650 V | −300 V | A | −650 V | −310 V | A |
| Example 214 | 211 | 1 | −650 V | −300 V | A | −650 V | −310 V | A |
| Example 215 | 212 | 1 | −650 V | −300 V | A | −650 V | −320 V | A |
| Example 216 | 209 | 1 | −650 V | −300 V | A | −610 V | −285 V | A |
| Example 217 | 210 | 1 | −650 V | −300 V | A | −650 V | −320 V | A |

What is claimed is:

1. An image forming method comprising:

preparing an electrophotographic photoreceptor which comprises:

a conductive support; and a photosensitive layer disposed on the conductive support, wherein the photosensitive layer on the farthest side from the conductive support, includes a surface layer containing at least one selected from the group consisting of:

i) fluorine based resin fine particles;

ii) a carbonate resin containing at least one of:

a copolymer having two or more repeating units selected from the group consisting of formula (I), (II), (III) and (IV) shown below; and a mixture containing two or more homopolymers having a repeating unit selected from the group consisting of formula (I), (II), (III) and (IV); and iii) an acrylate resin containing at least one of:

a copolymer having a repeating unit represented by the formula (VIII) and one or more repeating units selected from the group consisting of the formula (V), (VI) and (VII); and a mixture of one or more homopolymers having a repeating unit selected from the group consisting of the formula (V), (VI) and (VII) and a homopolymer having a repeating unit represented by the formula (VIII) shown below:

(I)

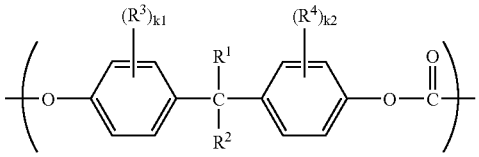

(II)

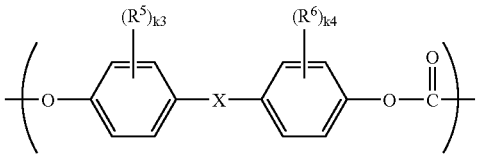

(III)

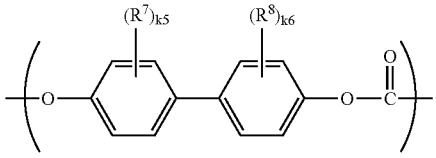

(IV)

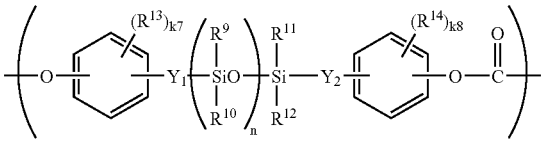

(V)

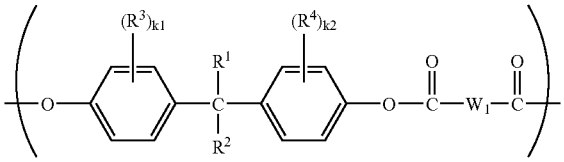

(VI)

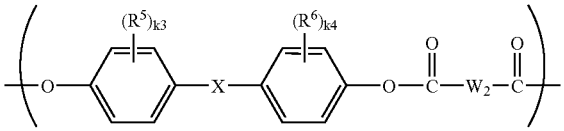

(VII)

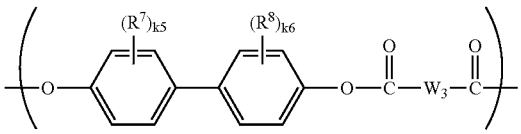

(VIII)

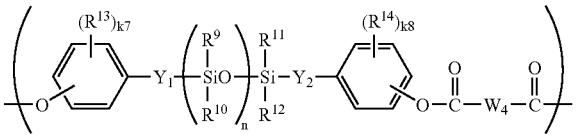

where $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; $R^5$ and $R^6$ each independently represents a halogen atom or a substituted or unsubstituted hydrocarbon group; $R^7$ and $R^8$ each independently represents a halogen atom or a substituted or unsubstituted hydrocarbon group; $R^9$ to $R^{12}$ each independently represents a halogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $W_1$ to $W_4$ each independently represents a divalent organic group having an aromatic ring; X represents a divalent organic group having a single ring or multiple rings; $Y_1$ and $Y_2$ each independent represents an alkylene group; $k_1$ to $k_8$ each represents an integer of from 0 to 4; and n represents an integer of from 0 to 150;

preparing a coated paper, wherein the coated paper comprises a substrate and a coated layer disposed on at least on surface of the substrate, the coated layer contains at least one of an adhesive containing latex having a glass transition temperature of 20° C. or higher and a pigment, and a surface, opposite to the substrate, of the coated layer has a glossiness of 10 % or more;

charging the electrophotographic photoreceptor;

exposing the charged electrophotographic photoreceptor to form an electrostatic latent image;

developing the electrostatic latent image with a toner to form a toner image; and transferring the toner image from the electrophotographic photoreceptor to the coated paper.

2. The image forming method according to claim 1, wherein the surface layer contains at least one of:

a copolymer having one or more repeating units selected from the group consisting of the formula (I), (II) and (III) and a repeating unit represented by the formula (IV); and a mixture of one or more homopolymers having a repeating unit selected from the group consisting of the formula (I), (II) and (III) and a homopolymer having a repeating unit represented by the formula (IV).

3. The image forming method according to claim 1, wherein the coated layer of the coated paper contains at least one of kaolin clay and talc.

4. The image forming method according to claim 1, wherein the surface layer further contains a fluorine based polymer.

5. The image forming method according to claim 1, wherein the transferring includes transferring the toner image onto the surface of the coated paper having a glossiness of 10% or more from the electrophotographic photoreceptor via an intermediate transfer body.

6. An image forming apparatus comprising:

an electrophotographic photoreceptor comprises:

a conductive support; and a photosensitive layer disposed on the conductive support, wherein the photosensitive layer on the farthest side from the conductive support, includes a surface layer containing at least one selected from the group consisting of:

i) fluorine based resin fine particles;

ii) a carbonate resin containing at least one of:

a copolymer having two or more repeating units selected from the group consisting of formula (I), (II), (III) and (IV) shown below; and a mixture containing two or more homopolymers having a repeating unit selected from the group consisting of formula (I), (II), (III) and (IV); and iii) an acrylate resin containing at least one of:

a copolymer having a repeating unit represented by the formula (VIII) and one or more repeating units selected from the group consisting of the formula (V), (VI) and (VII); and a mixture of one or more homopolymers having a repeating unit selected from the group consisting of the formula (V), (VI) and (VII) and a homopolymer having a repeating unit represented by the formula (VIII) shown below:

(I)

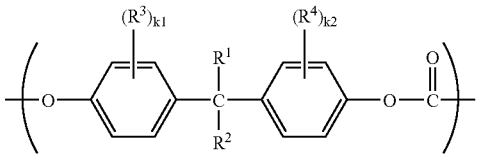

(II)

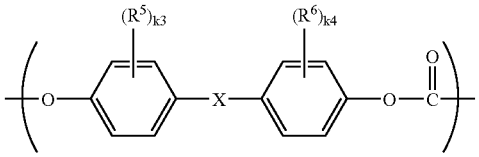

(III)

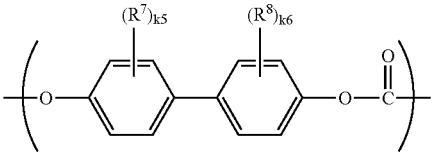

(IV)

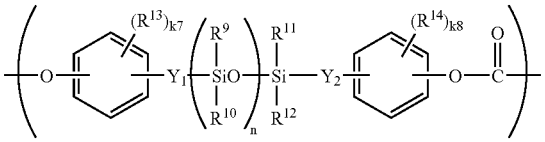

(V)

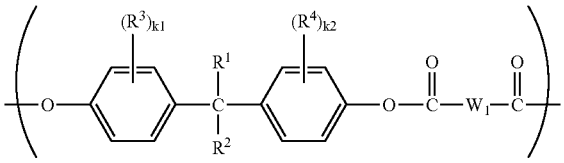

(VI)

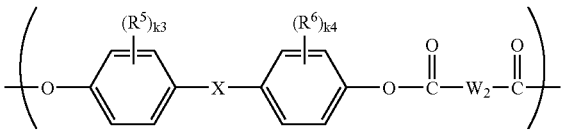

(VII)

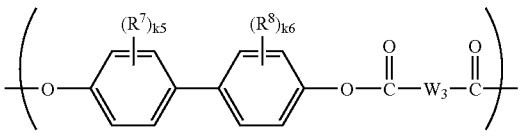

-continued (VIII)

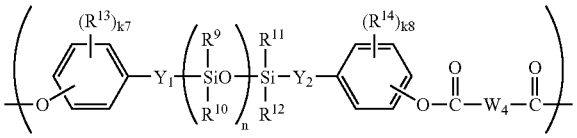

where $R^1$ and $R^2$ each independently represents a hydrogen atom, a substituted or unsubstituted hydrocarbon group, or a substituted or unsubstituted heterocyclic group; $R^3$ and $R^4$ each independently represents a halogen atom or a substituted or unsubstituted hydrocarbon group; $R^5$ and $R^6$ each independently represents a halogen atom or a substituted or unsubstituted hydrocarbon group; $R^7$ and $R^8$ each independently represents a halogen atom or a substituted or unsubstituted hydrocarbon group; $R^9$ to $R^{12}$ each independently represents a halogen atom, a substituted or unsubstituted hydrocarbon group, or a substituted or unsubstituted heterocyclic group; $R^{13}$ and $R^{14}$ each independently represents a halogen atom or a substituted or unsubstituted hydrocarbon group; $W_1$ to $W_4$ each independently represents a divalent organic group having an aromatic ring; X represents a divalent organic group having a single ring or multiple rings; $Y_1$ and $Y_2$ each independent represents an alkylene group; $k_1$ to $k_8$ each represents an integer of from 0 to 4; and n represents an integer of from 0 to 150;

a charging unit for charging the electrophotographic photoreceptor;

an exposure unit for exposing the charged electrophotographic photoreceptor to form an electrostatic latent image;

a development unit for developing the electrostatic latent image with a toner to form a toner image; and a transfer unit for transferring the toner image from the electrophotographic photoreceptor to the coated paper.

7. The image forming apparatus according to claim 6, wherein the paper comprises:

a substrate; and a coated layer disposed on at least one surface of the substrate, and wherein the coated layer contains at least one of an adhesive containing latex having a glass transition temperature of 20° C. or higher and a pigment, and a surface, opposite to the substrate, of the coated layer has a glossiness of 10% or more.

8. The image forming apparatus according to claim 6, wherein the surface layer contains at least one of:

a copolymer having one or more repeating units selected from the group consisting of the formula (V), (VI) and (VII) and a repeating unit represented by the formula (VIII); and a mixture of one or more homopolymers having a repeating unit selected from the group consisting of the formula (V), (VI) and (VII) and a homopolymer having a repeating unit represented by the formula (VIII).

9. The image forming apparatus according to claim 6, wherein the coated layer of the coated paper contains at least one of kaolin clay and talc.

10. The image forming apparatus according to claim 6, wherein the surface layer further contains a fluorine based polymer.

11. The image forming apparatus according to claim 6, wherein the transfer unit includes an intermediate transfer body.

12. The image forming apparatus according to claim 11, wherein the intermediate transfer body transfers the toner image on the surface of the coated paper having a glossiness of 10% or more.

13. The image forming method according to claim 1, wherein the content of the fluorine based resin fine particles is in a range of from 3 to 40% by weight based on the total amount of the fluorine based fine particle-containing layer as the electrophotographic photoreceptor.

14. The image forming apparatus according to claim 6, wherein the content of the fluorine based resin fine particles is in a range of from 3 to 40% by weight based on the total amount of the fluorine based fine particle-containing layer as the electrophotographic photoreceptor.

* * * * *